US006188181B1

(12) United States Patent
Sinha et al.

(10) Patent No.: US 6,188,181 B1
(45) Date of Patent: Feb. 13, 2001

(54) LIGHTING CONTROL SYSTEM FOR DIFFERENT LOAD TYPES

(75) Inventors: Siddharth Prakash Sinha; Robert S. Balog, Jr., both of Allentown, PA (US)

(73) Assignee: Lutron Electronics Co., Inc., Coopersburg, PA (US)

( * ) Notice: Under 35 U.S.C. 154(b), the term of this patent shall be extended for 0 days.

(21) Appl. No.: 09/139,609

(22) Filed: Aug. 25, 1998

(51) Int. Cl.[7] ..... H05B 37/02

(52) U.S. Cl. ..... 315/293; 315/294; 315/295; 315/316

(58) Field of Search ..... 315/294, 293, 315/292, 297, 316, 324, 295

(56) References Cited

U.S. PATENT DOCUMENTS

| | | | |
|---|---|---|---|
| 4,733,138 | 3/1988 | Pearlman et al. | 315/307 |
| 5,430,356 | 7/1995 | Ference et al. | 315/291 |
| 5,530,322 | 6/1996 | Ference et al. | 315/295 |
| 5,668,537 | 9/1997 | Chansky et al. | 340/825.06 |
| 5,769,527 | 6/1998 | Taylor et al. | 362/85 |
| 5,770,928 | 6/1998 | Chansky et al. | 315/362 |

*Primary Examiner*—David Vu
(74) *Attorney, Agent, or Firm*—Woodcock Washburn Kurtz Mackiewicz & Norris

(57) ABSTRACT

An improved signal generator that is capable of providing a multitude of control schemes to connected ballasts or transformers to adjust the luminous output of an attached lamp or light source. The control scheme is preferably at least one of the type 0 to 10V sink, 0 to 10V source, pulse width modulated (PWM), and digital serial interface (DSI). A lighting control system for selectively controlling the respective light levels of a plurality of lighting loads of different load types, comprising a lighting control unit for generating zone-intensity information representing a desired light level for lighting loads including light sources on a communications link, each lighting load being one of a plurality of voltage controlled load types, duty cycle controlled load types, and digital signal controlled load types; a controller operatively connected to the lighting control unit via the communications link and responsive to the zone-intensity information on the communications link for adjusting the light level of the lighting loads; and a plurality of modules connected between the controller and the lighting loads, each module capable of controlling at least one of the lighting loads.

23 Claims, 22 Drawing Sheets

DIGITAL SERIAL INTERFACE

ELECTRICAL SPECIFICATIONS

1. SIGNAL SPECIFICATIONS

| | |
|---|---|
| LOGICAL 1 (HIGH) VOLTAGE: | 12V ± 10% |
| LOGICAL 0 (LOW) VOLTAGE: | <0.5V |
| MINIMUM RISE/FALL TIME (BETWEEN 10%...90% OF SIGNAL): | 2V/μs |
| BAUDRATE: | 1200Bd ± 9% |

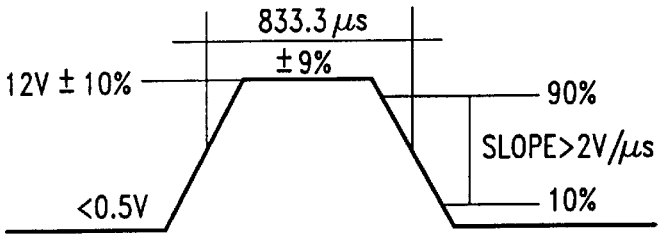

2. CONTROL CHARACTERISTICS

THE CONTROLLABLE BALLAST IS ABLE TO OPERATE WITHOUT A CONTROL SIGNAL. IN THAT CASE THE POWER OUTPUT IS 100%.

THE DECIMAL VALUE n OF THE DIGITAL 8 BIT CONTROL WORD RANGES FROM n = 0 UP TO n = 255.

THE DEPENDENCE OF OUTPUT POWER P(n) ON THE DECIMAL VALUE n (n=1...255) SHALL HAVE A DEVIATION OF LESS THAN ± 3% FROM THE FOLLOWING CHARACTERISTICS:

| | |
|---|---|
| n = 0 | LIGHT OFF (BALLAST IN STAND-BY) |
| n = 1+127 * LOG (P(%) ) | P(%) ... DIMMING LEVEL IN % |

THIS RESULTS IN

| | |
|---|---|
| 1% POWER FOR | N=1 |
| 100% POWER FOR | N=255 |

AND A LOGARITHMIC DIMMING CHARACTERISTIC.

FIG. 1H

LIGHTING CONTROL SYSTEM FOR DIFFERENT LOAD TYPES

FIELD OF THE INVENTION

The present invention relates to improvements in lighting control systems of the type used to send low voltage control signals to electronic ballasts and transformers for controlling an attached lighting load.

BACKGROUND OF THE INVENTION

There are lighting control systems that operate to control multiple zones of lighting through multiple dimming circuits to achieve any one of several desired lighting scenes. These systems include wallbox mounted control units which operate to multiplex digital lighting control information on a communications link. Each wallbox mounted control unit includes zone-intensity actuators which are manipulable to alter the information transmitted by their respective wallbox mounted control unit to vary the lighting intensity of an associated lighting zone. A central control panel (controller) includes a microprocessor adapted to receive and process the multiplexed information transmitted on the link, and re-transmit digital lighting control information, on a second multiplex link, to the dimming circuits. The microprocessor is programmed to assign a preselected dimming circuit to any one of the zone-intensity actuators when that actuator is manipulated according to a predetermined sequence.

There are systems for assigning actuators of a wallbox-mountable lighting control unit to one or more dimmer circuits located in a separate dimming panel for controlling an attached lighting load. The dimmer circuits use a phase control output to adjust the RMS voltage across the load and hence its luminous intensity. A system of this type is commercially available from Lutron Electronics Co., Inc. and is sold under the registered trademark GRAFIK Eye® dimming panel.

In a GRAFIK Eye system, the output from the wallbox control unit (main unit) is an RS485 digital output. The GRAFIK Eye main units are connected on a four-wire link with each of the main units wired in a daisy chain fashion. Each main unit sends out zone-intensity data over the four-wire link to a control panel located in a dimming panel or relay panel. The information comes into the control panel as a unit address, a zone number, and an intensity value. The control panel takes the unit address, the zone number, and the intensity value, and maps it to the appropriate dimming cards in the GRAFIK Eye dimming panel or a relay in the GRAFIK Eye relay panel. Each dimming/relay card is connected to the control panel through a two-wire harness. The two-wire harness attaches to the dimming/relay card through a multiple pin connector. The first two pins of the connector are for receiving the serial data from the control panel. The other pins of the harness are used to assign an address to each dimming/relay card. This type of system is described in commonly assigned U.S. Pat. No. 5,530,322, "Multi-Zone Lighting Control System," issued to Ference et al. This patent is herein incorporated by reference.

It is known that a wallbox-mountable lighting control system can be adapted to dim a plurality of groups of light sources in a room to any one of a number of different preset levels to achieve a like number of different lighting scenes. Each group of light sources defines a lighting zone and typically each zone is made up of the same type of light source, for example, incandescent lamps, fluorescent lamps, neon lamps, etc. which are all controlled by a phase controlled output. The system includes dimmers for adjusting the respective light level of the different lighting zones, and a display panel for displaying the instantaneous light level of each zone. A suitably programmed microprocessor or the like operates to normalize the system's dimming performance for different types of light sources so that a given change in dimmer setting produces the same change in perceived light level from each of the different types of light sources. The system user inputs the type of light source used in each zone by a software scheme that operates the light level indicators of the display panel in an alternative mode to indicate the various types of light sources. A system of this type is commercially available from Lutron Electronics Co., Inc. and is sold under the registered trademark GRAFIK Eye 3000 Series. This type of system is described in commonly assigned U.S. Pat. No. 5,430,356, "Programmable Lighting Control System With Normalized Dimming For Different Light Sources," issued to Ference et al. This patent is herein incorporated by reference.

Thus, the prior art system controls different loads, but always with a phase controlled output. Separate devices/modules are available for controlling the intensity of different lighting load types which do not use a phase controlled output, such as voltage controlled load types (e.g., 0 to 10 volt sink and 0 to 10 volt source), duty cycle controlled load types (e.g., pulse width modulated (PWM)), and digital signal controlled load types (e.g., digital serial interface (DSI)). However, there is no single device/module that controls the intensity of several different lighting load types where the load types are voltage controlled load types, and/or duty cycle controlled load types, and/or digital signal controlled load types. Therefore, a need exists for a device / module that overcomes the drawbacks of the prior art and controls the intensity of different load types including voltage controlled load types, duty cycle controlled load types, and digital signal controlled load types.

SUMMARY OF THE INVENTION

In view of the foregoing discussion, it is an object of the present invention to provide an improved signal generator that is capable of providing a multitude of control schemes to connected ballasts or transformers to adjust the luminous output of an attached lamp (hereinafter also referred to as a light source or a lighting load). The control scheme is preferably at least one of the type 0 to 10V sink, 0 to 10V source, pulse width modulated (PWM), and digital serial interface (DSI).

It is also an object of this invention to provide a circuit for enabling a multitude of different control schemes to be outputted to an attached lighting load.

The present invention is directed to a lighting control system for selectively controlling the respective light levels of a plurality of lighting loads, each of the loads including a light source, each lighting load being one of a plurality of a voltage controlled load type, a duty cycle controlled load type, and a digital signal controlled load type. The lighting control system comprises a lighting control unit for generating zone-intensity information representing a desired light level for at least one of the plurality oflighting loads and placing the zone-intensity information on a communications link; a controller operatively connected to the lighting control unit via the communications link and responsive to the zone-intensity information on the communications link for adjusting the light level of the at least one lighting load; and a plurality of modules, each module being connected between the controller and at least one of the lighting loads, each module capable of controlling the light level of at least two of the load types.

According to one aspect of the present invention, an isolator is operatively connected between the controller and at least one of the modules. In accordance with another aspect of the present invention, a relay is operatively connected between the power source and at least one of the lighting loads, wherein each relay is controlled by the controller.

In accordance with a further aspect of the present invention, input means are provided for inputting the zone-intensity information to the lighting control unit. In accordance with another aspect of the present invention, an over-current protector and a miswire protector are connected between each of the modules and their associated lighting loads.

In accordance with further aspects of the present invention, the controller or a selector on a module provides a load type signal to the module.

In a further embodiment within the scope of the present invention, a module is provided for controlling the light intensity of at least one lighting load in a lighting control system, each lighting load including a light source and being one of a voltage controlled load type, a duty cycle controlled load type, and a digital signal controlled load type. The module comprises input means for receiving at least one of the voltage controlled load type, duty cycle controlled load type, and digital signal controlled load type, and an intensity level; a controllably conductive device capable of generating an output signal responsive to the intensity level to at least two of the load types; and output means for outputting the output signal to the at least one lighting load.

According to an aspect of the present invention, the module controls the light intensity of two lighting loads, and the output means comprises two output terminals, each connected to a respective one of the two lighting loads for controlling the light intensity of the two lighting loads. According to another aspect of the present invention, the two lighting loads are different load types.

According to another aspect of the present invention, the input means receives a multiplexed input signal comprising the intensity level and a load type signal. The load type signal indicates whether the load type is a voltage controlled load type or a duty cycle controlled load type or a digital signal controlled load type. The intensity level is provided in a signal, and the load type is provided in either the same signal or a separate signal. The separate signal can be provided by a rotary encoder or a dual-inline package (DIP) switch, for example.

The foregoing and other aspects of the present invention will become apparent from the following detailed description of the invention when considered in conjunction with the accompanying drawings.

BRIEF DESCRIPTION OF THE DRAWINGS

FIG. 1H shows the electrical specification for a digital serial interface (DSI);

DESCRIPTION OF EXEMPLARY EMBODIMENTS AND BEST MODE

The present invention is directed to a low voltage module (LVM) and system to control different lighting loads including light sources having different voltage controlled load types, duty cycle controlled load types, and digital signal controlled load types, such as 0 to 10 sink, 0 to 10 source, pulse width modulated (PWM), and digital serial interface (DSI). The load types are selectable.

Figure 1A:
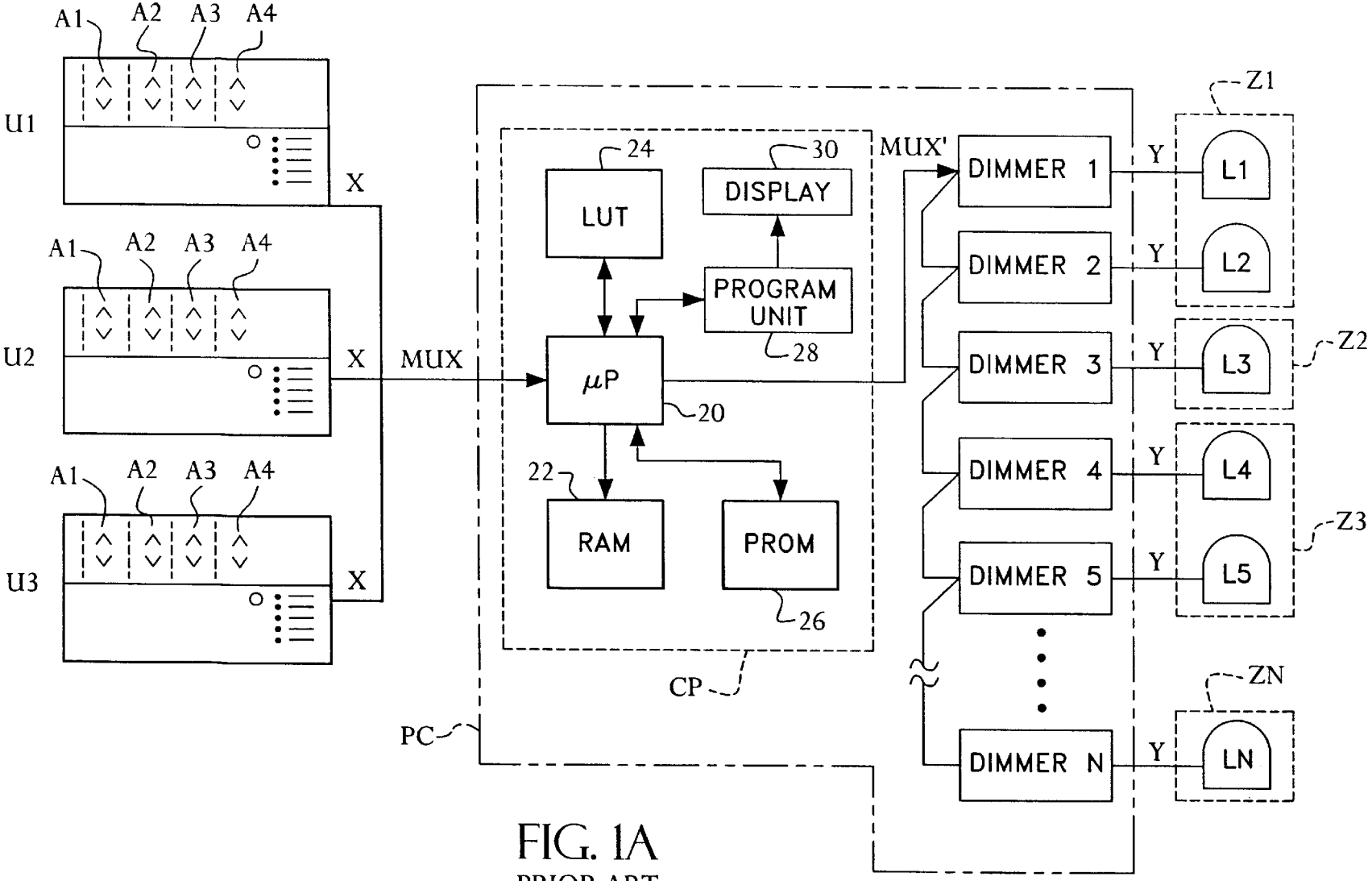
FIG. 1A PRIOR ART
FIG. 1A is a block diagram of a multi-zone lighting control system of the prior art.

FIG. 1A schematically shows a multi-zone lighting control system of the prior art in which a plurality of lighting control units U1, U2, U3 operate through a plurality of dimmers (dimmer 1 through dimmer N) to control the output intensity of a plurality of lighting loads L1 through LN, each lighting load includes a light source. The lighting load may be an incandescent lamp, a low voltage incandescent lamp or a neon lamp connected to a transformer, or a fluorescent lamp connected to a ballast. Zone intensity information in the form of multiplex data (MUX) is sent from the control units U1, U2, U3 to the control panel CP located in the power cabinet PC. The control panel CP is used to assign zones A1 through A4 to dimmers (dimmers 1 through dimmer N). The output of the control panel CP, a multiplexed signal MUX', is connected to the dimmers. The control panel CP repeatedly sends four types of information to the dimmers. This information includes low end trim, high end trim, zone intensity, and load type. A microprocessor in each dimmer processes the information and controls a controllable conductive device (CCD) (triac) to output a phase controlled signal to the loads L1 through LN. Low end trim is the lowest light intensity the load L1 through LN will output. This relates to the latest time in each half cycle that the triac will turn on. High end trim is the highest light intensity the load L1 through LN will output. This relates to the earliest time in each half cycle that the triac will turn on. Both the low end trim and the high end trim are adjustable by the end user. Zone intensity is the desired light output from the load L1 through LN. Zone intensity relates to the time in each half cycle that the triac turns on. It has a range between high end and low end. The zone intensity is a number between 00 and 127. 00 means dimmer "off", 01 means the dimmer should go to low end, and 127 means the dimmer should go to high end. The microprocessor on the dimmer divides the amount of time between when the triac turns on at high end and when the triac turns on low end in to 127 steps and uses the zone intensity information as a percentage to set the time at which the triac turns on.

There are several load types available in the system of the prior art (e.g., incandescent/magnetic low voltage, fluorescent, neon/cold cathode, non-dim, and electronic low voltage). The output from each of the dimmers (dimmer 1 through dimmer N) is always a phase controlled output, i.e., the controllable conductive device is signaled to turn on a certain time period after the zero cross in each half cycle. When the controllable conductive device turns on in each half cycle it is a function of the low end, high end, zone intensity information, and the load type information. Load type information is used by the dimmer/relay card to set a maximum high end trim and a minimum low end trim. The user cannot set the high end trim above the maximum high end trim set by the load type and cannot set the low end trim below the minimum low end trim set by the load type. All the mentioned load types can be put into two categories: dimmable and non-dimmable. If a load type "dimmable" is received from the control panel CP into the microcontroller in the dimmer the microcontroller interprets a "00" as relay open and controllable conductive device (e.g., triac) off, a "01–""127" as relay closed and controllable conductive device to a level based on low end, high end, and zone intensity. If a load type "non-dimmable" is received from the control panel CP into the microcontroller in the dimmer the microcontroller interprets a "00" as relay open and controllable conductive device (e.g., triac) off, and typically a "01–""127" as relay closed and controllable conductive device on full (i.e., full conduction).

Figure 1B:
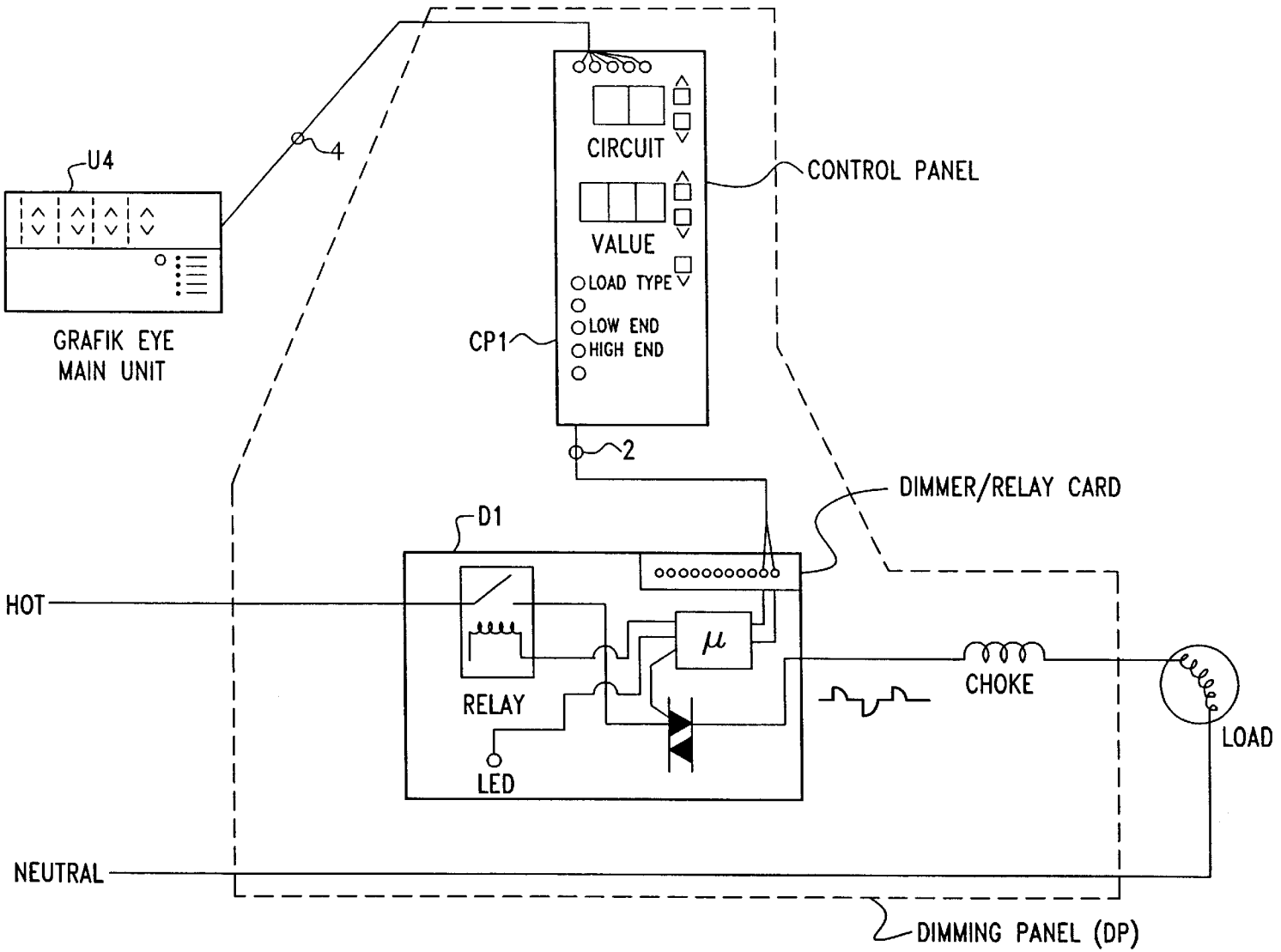
FIG. 1B is a more detailed block diagram of a multi-zone lighting control system of the prior art.

FIG. 1B shows three of the major components of the system of the prior art: a lighting control unit U4, a control panel CP1, and a dimmer card D1. The lighting control unit U4 is a GRAFIK Eye 4000 Series preset lighting controller, the control panel CP1 and the dimmer/relay card are housed in a dimming panel DP available in a GRAFIK Eye 4000 Series dimming panel. All three components are available from the assignee of the present application. The dimmer/relay card takes in power from a HOT lead and either provides a phase controlled output or a switched output to the load, shown as an incandescent lamp without a transformer, through a CHOKE. The dimmer/relay card utilizes a sequence of closing the relay, waiting for the relay to stop bouncing, and then turning on the controllable conductive device (a triac is shown) to reduce the amount of arcing at the relay when the relay is first closed. The controllable conductive device remains in series with the load whenever the relay is closed and is secured to a heat sink to dissipate any generated heat. The controllable conductive device also helps reduce the current surge when the dimmer/relay card is connected to a capacitive load such as an electronic ballast or transformer. A dimmer/relay card of the prior art can be used in the invention of the present application to provide switched power to the connected load, as will be described below. A heavy duty relay could alternatively be used to provide switched power to the load. Some lighting loads do not require an external relay or switch because they have an internal relay or switch in their ballast or transformer. The dimmer/relay card combined with a choke of the prior art also further reduces the surge of current associated with capacitive loads.

Figure 1C:
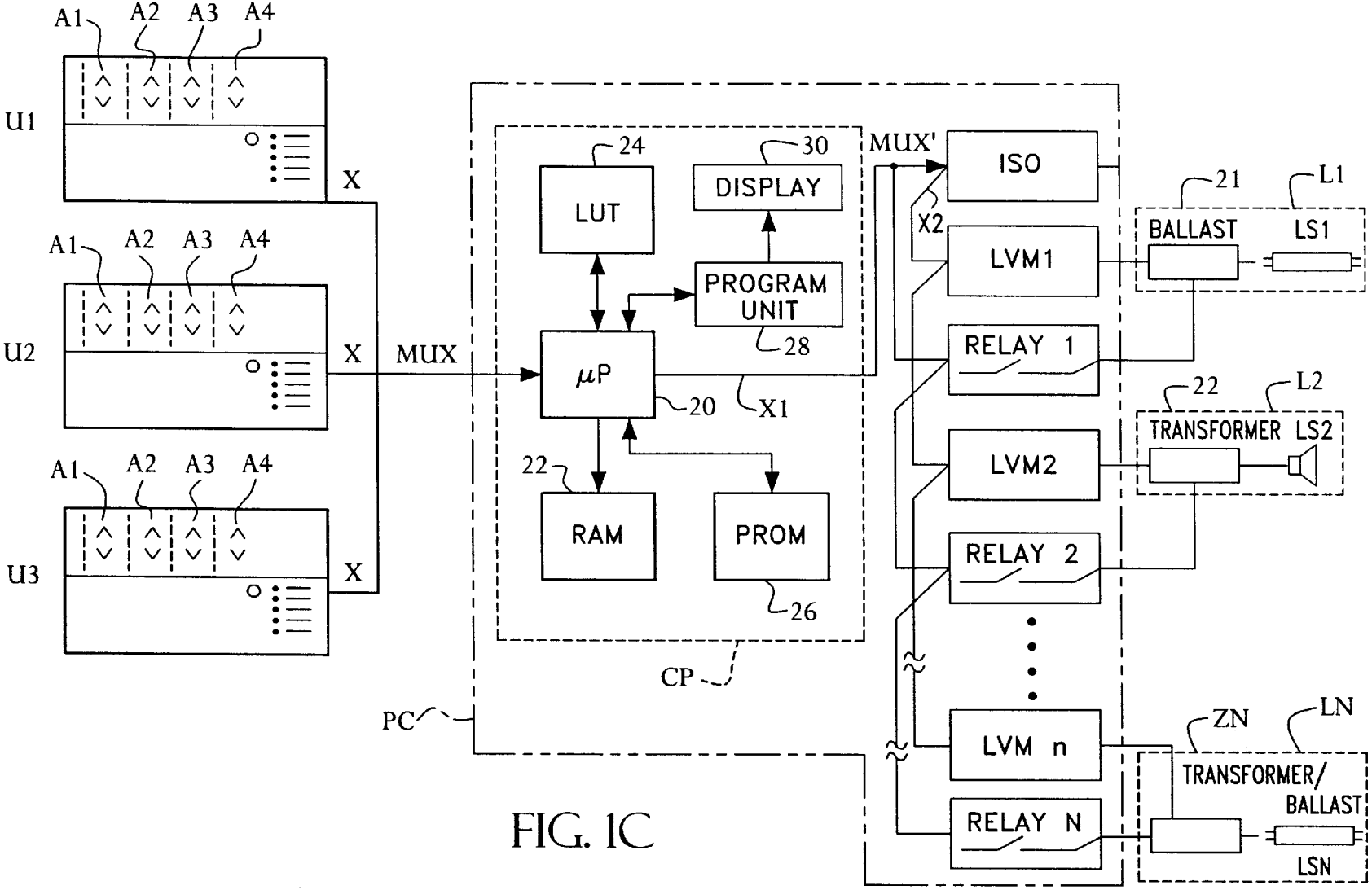
FIG. 1C is a block diagram of an exemplary lighting control system in accordance with the present invention.

Referring now to the drawings, FIG. 1C schematically illustrates a lighting control system in which a plurality of lighting control units U1, U2, U3 (wherein like numerals indicate like components) operate through a plurality of low voltage modules (LVM 1 through LVM n with associated relays 1 through N) to control the output intensity of a plurality of lighting loads L1 through LN of voltage controlled load types and/or duty cycle controlled load types and/or digital signal controlled load types. Although the LVMs are shown individually, more than one LVM can be combined into the same module, along with their associated relays. The lighting loads L1 through LN can all be the same, all be different, or some can be the same and some different. While each of the lighting loads is schematically depicted as comprising a single light source LS1, LS2, LSN, it will be appreciated that each lighting load usually comprises several, and often many, individual light sources. The light sources are operated by a ballast or a transformer that is voltage controlled, duty cycle controlled, or digital signal controlled. As shown, each lighting load defines an associated lighting zone Z1 through ZN. The light intensity of each zone is controlled by the output of the associated LVM. The LVM sends control signals to a connected ballast or transformer which in turn controls the luminous output of the lamp.

In addition to controlling LVMs, the lighting control units U1, U2, U3 can also control dimmers with a phase controlled output as described above in connection with FIG. 1A. Hence, LVMs and dimmers can be mixed in the same system.

In the system of FIG. 1C, control units U1–U3 are of conventional design, each comprising a plurality of zone-intensity actuators A1–A4, shown as a pair of raise/lower push buttons, which can be manually manipulated to vary a characteristic of a lighting control signal produced at the output X of each unit. The respective outputs of the control units U1–U3 serve to control the respective outputs of the LVMs and, hence, the light intensity of the lighting zones. Each of the actuators A1–A4 controls at least one LVM to control the light intensity in a particular lighting zone to which the LVMs are assigned, e.g., actuator A1 of control unit U1 may control the lighting intensity in zone Z1 by controlling the output of LVM1. In the control units shown, physically depressing the raise or lower push button acts to raise or lower the light level. In some control units, however, the zone-intensity actuator may take the form of a slide control which, through suitable circuitry, have the same effect on the control unit output. Suitable control units for the FIG. 1C system are the so-called GRAFIK Eye Lighting Controls, Models 3000 or 4000, made by Lutron Electronics Co., Inc.

Lighting control units U1–U3 are usually wall-mounted devices, each being mounted in a wallbox located in the vicinity of the light sources or fixtures they control. The control units communicate with the various LVMs through a programmable control panel circuit CP which, together with the LVMs, is housed in a power cabinet PC located remote from the controls and light sources, e.g,. in an electrical closet. The control panel circuit CP includes a microprocessor 20, such as a Motorola HC11, which receives multiplexed zone-intensity information transmitted by the control units over a digital communications link MUX.

Upon being sequentially polled in a conventional manner, each control unit transmits, in accordance with an established protocol, a serial message on the link, such message representing digitally encoded zone-intensity information determined by the position of its zone actuators. Polling of the control units is typically effected at a relatively fast rate, e.g., once every 100 ms, each control unit taking its turn in a predefined time slot. Upon receiving and de-multiplexing the zone-intensity information from the lighting control units, the microprocessor stores this information in a conventional random access memory (RAM) 22, updating the memory with fresh intensity information every polling cycle. The zone-intensity information can be stored in tabular form. The control panel CP outputs signals on communications link X1 in the form of a multiplexed signal MUX'.

The control panel circuit CP further comprises a look-up table (LUT) 24, preferably a standard EEPROM (not shown), a programmable ROM (PROM) 26, and a programming unit 28 and an interactive display 30 through which the LUT 24 can be programmed to assign each LVM to a particular zone actuator. While shown separately, it will be appreciated that the LUT 24 and PROM 26 are often integral portions of the microprocessor 20.

Figure 1D:
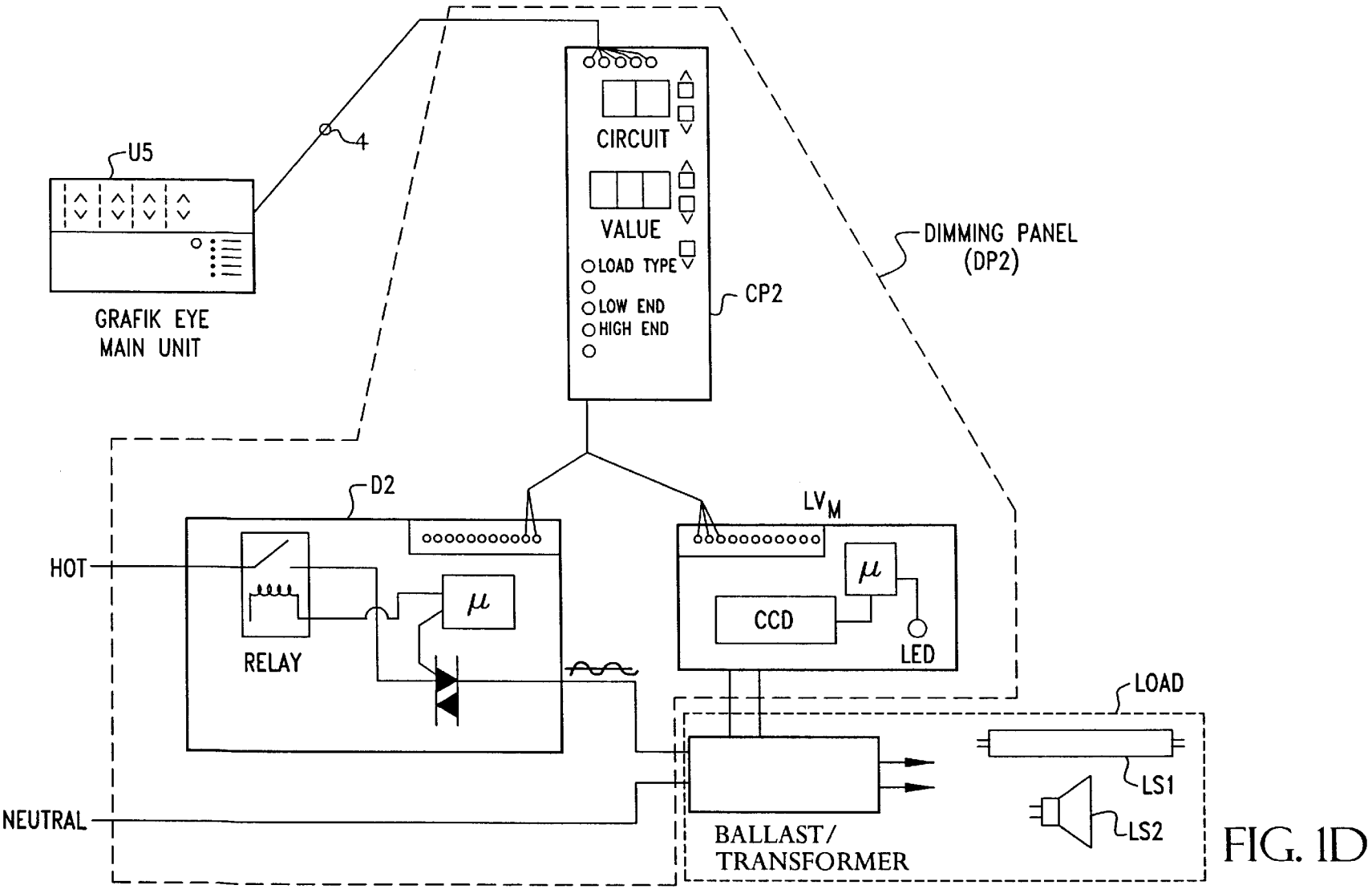
FIG. 1D is a more detailed block diagram of a multi-zone lighting control system of the present invention without the isolator ISO.

FIG. 1D shows a more detailed block diagram of a multi-zone lighting control system of the present invention. A lighting control unit U5 (similar to control units U1–U3 described in FIG. 1C), such as a GRAFIK Eye lighting controller, transmits zone intensity information to a control panel CP2 (similar to control panel CP described in FIG. 1C). The control panel CP2 controls an LVM and a dimmer/relay card D2. The dimmer/relay card D2 is used in this embodiment to connect and disconnect line voltage from the HOT lead to the ballast or transformer. The dimmer/relay card is similar to dimmer/relay card D1 of FIG. 1B. The ballast or transformer receives control signals from the LVM and line voltage from the dimmer/relay card D2. The dimmer/relay card D2 and the LVM are housed in a dimming panel DP2. Note that in this embodiment, an isolator ISO is not provided.

Figure 1E:
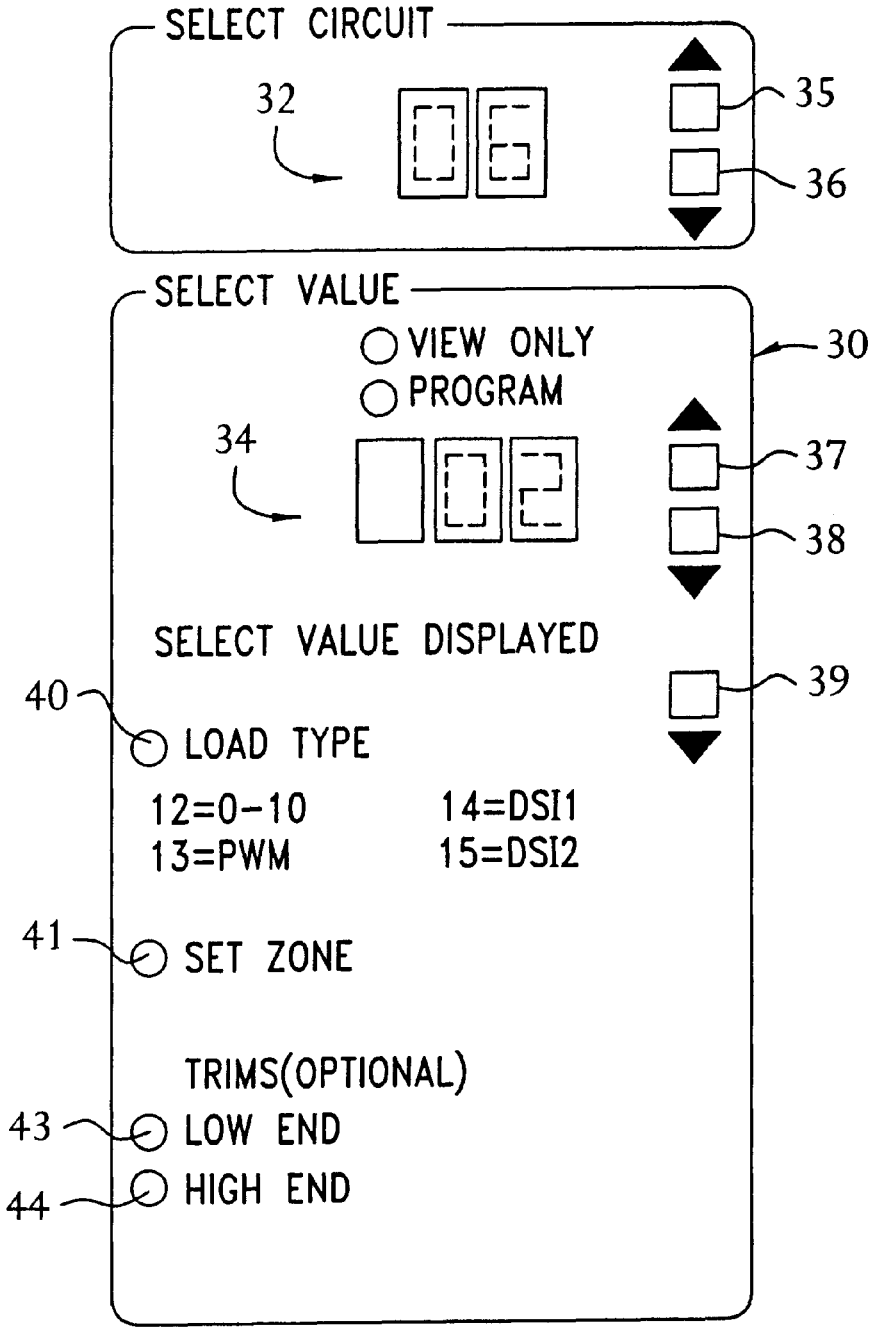
FIG. 1E is a front plan view of an interactive display panel useful in programming the programmable control panel of FIG. 1C.

FIG. 1E shows an exemplary interactive display 30 which is illustrated as comprising a pair of seven-segment LED (light emitting diodes) displays 32, 34, a series of push-button switches 35–39, and single LEDs 40, 41, 43, and 44. Display 32 is adapted to show a number representing a particular LVM module. A desired LVM module number is selected by repeatedly depressing the appropriate up/down buttons 35, 36 until the display 32 shows the desired LVM module number.

Button 39 is repeatedly depressed, thereby causing the LEDs 40, 41, 43, and 44 to become illuminated, one at a time. These LEDs respectively identify various internal programs that are stored in the PROM 26, each program enabling the user to adjust certain parameters and store certain values. When LED 40 is illuminated, for example, a program is accessed which allows the user to choose one of several different load types (i.e., 0 to 10 volt source and sink, PWM, and DSI 1 and 2) by depressing the up/down buttons 37, 38 until the number (from 12 to 15) is shown on the display 34. For example, load type number 12 corresponds to a 0 to 10 volt load type (both sink and source), load type number 13 corresponds to PWM, load type numbers 14 and 15 correspond to DSI in which a relay is not opened and a relay is opened (due to the internal configuration of the light source), respectively. Based on the load type chosen, the programming unit causes the microprocessor 20 to transmit a load type signal to the selected LVM module, causing the LVM module to configure its circuitry to drive the appropriate load, to be described below. This load type signal is repeatedly sent to the associated LVM.

When LEDs 43 or 44 are illuminated, programs are accessed which allow the user to set either the lowest or highest intensity level for the load connected to the selected LVM module. When LED 41 is illuminated, the operator can assign a desired zone actuator to the selected LVM module through the interactive display 30. In a preferred embodiment, the display 34 alternately displays, for one second intervals, a particular control unit number, e.g., U1, and a particular actuator number, e.g., A1. By depressing the up/down buttons 37, 38 at the appropriate time, the operator can increment the displayed number by one and thereby select a desired control unit and zone actuator. Having selected both the LVM module number and the actuator number, the microprocessor 20 assigns (or re-assigns) this particular actuator to the selected LVM module after a preset time interval has elapsed, and stores this assignment in the LUT 24.

Referring again to FIG. 1C, the output of the control panel CP is provided to an isolator ISO which optically isolates the control panel from the LVMs. The output of the control panel CP is provided to the LVMs and their associated relay. The output includes zone intensity, low end trim, high end trim, and load type information. The zone intensity value ranges from 00 to 127, with 00 interpreted as an off by the LVM. If the zone intensity value is 00, the associated relay is opened and if the value is not 00 (i.e., any value from 1 to 127), the relay is closed so that the light source can be controlled. The LVM controls the intensity level of the light source based on the intensity value it is provided by the control panel CP. When the associated relay is open, line voltage is disconnected from the ballast or transformer and the load is off. When the relay is closed, line voltage is connected to the ballast or transformer and the load will be illuminated at a level set by the intensity value.

In a preferred embodiment, each LVM controls two zones. As described in further detail below, the microcontroller in the LVM preferably will not accept any address that has not been constant for a predetermined time, e.g., at least about 500 msec. The microcontroller preferably recognizes the following data types: load type, high end trim, low end trim, and intensity value. Preferably, the output control signals are sent three times to ensure proper transmission and are repeated about every 1 to 2 seconds.

Figure 1F:
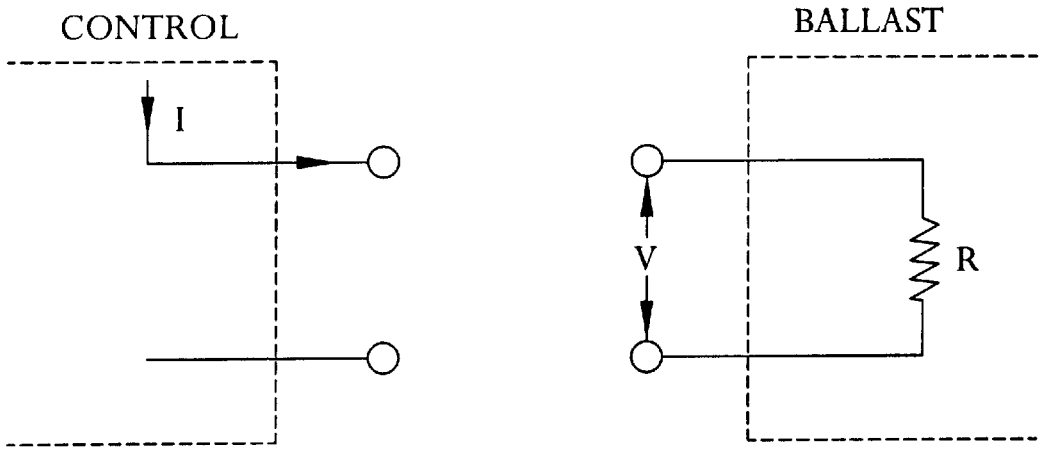
FIGS. 1F and 1G are electrical schematics of a sink ballast and a source ballast, respectively.
Figure 1G:
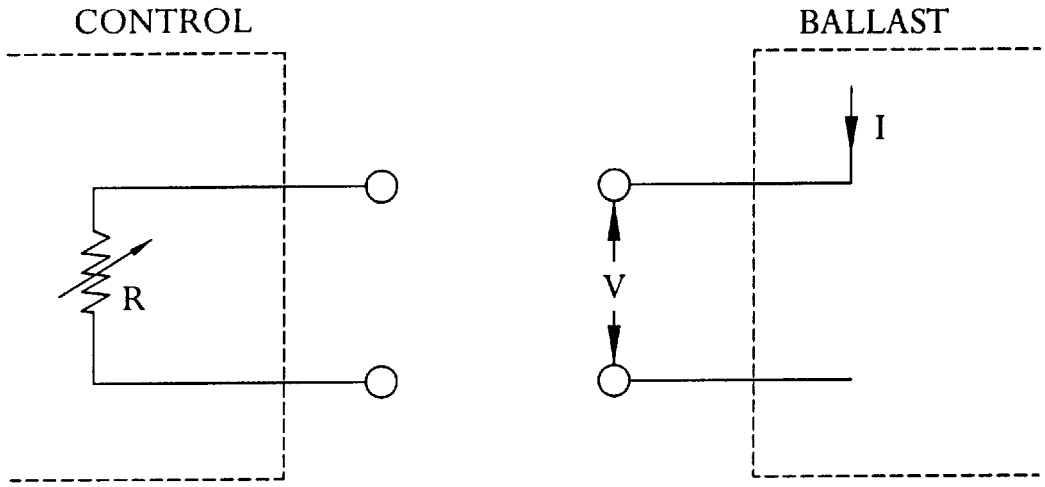

FIGS. 1F and 1G are electrical schematics of a sink ballast and a source ballast, respectively. In the sink ballast of FIG. 1F, the current I is controlled to set a certain voltage V. In the source ballast of FIG. 1G, the resistance R is controlled to set a certain voltage V.

The digital serial interface (DSI) was developed by Tridonic and has typical signal specifications of a voltage range between about 0 and about 12 volts, with a minimum rise/fall time between about 10% and about 90% of the signal of about 2 V/$\mu$s. The digital information is transferred in Manchester code; i.e., each bit and its inverse bit are sent subsequently. One complete 8 bit word of information is transferred by the combination of 21 bits: 1 start bit (logical 0), 8 bits of data with their 8 inverse bits, and 4 stop bits (logical 0).

FIG. 1H further details the signal specifications and control characteristics for a DSI output as specified from Tridonic.

Figure 2:
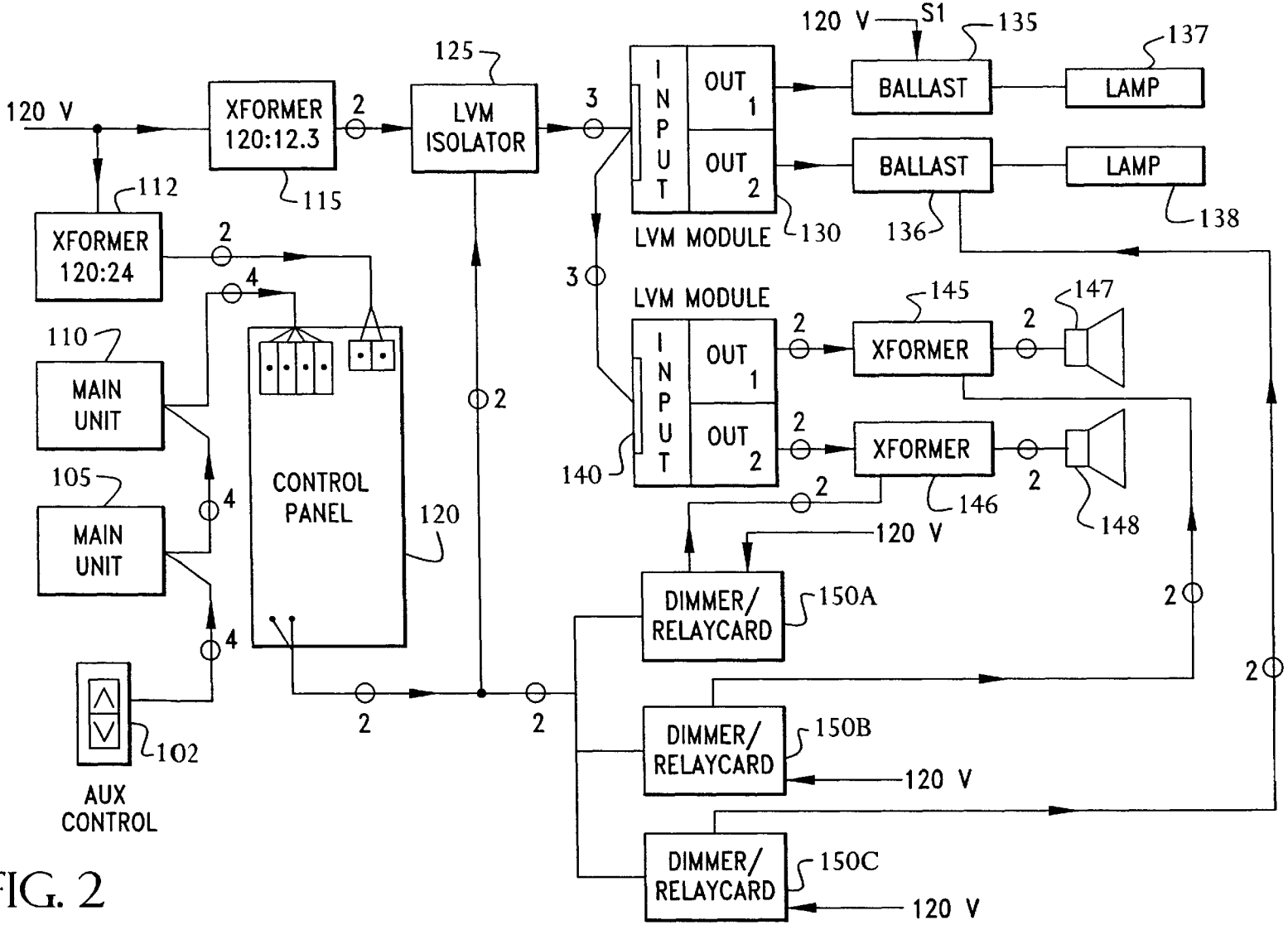
FIG. 2 is a more detailed block diagram of another exemplary lighting control system in accordance with the present invention.

FIG. 2 is a more detailed block diagram of another exemplary lighting control system in accordance with the present invention. Power, typically 120 volts AC, although any source voltage will work, is supplied to transformers 112 and 115. The transformers 112, 115 preferably step the power down to 24 volts AC and 12.3 volts AC, respectively, and provide the stepped down voltage to the control panel 120 and LVM isolator 125, respectively. The control panel 120 and the LVM isolator 125 correspond to the control panel CP and isolator ISO, respectively, in FIG. 1C. An auxiliary controller 102 is connected to main units 105, 110 (which correspond to control units U1 and U2 in FIG. 1C) which are connected to the control panel 120. The main units 105, 110 operate in a similar manner to the control units U1 and U2 described above.

The output from the control panel 120 is provided to the LVM isolator 125 and to dimmer/relay cards 150A, 150B, and 150C. The dimmer/relay cards 150A, 150B, and 150C each comprise relays which are similar to the relays in FIG. 1C. The LVM isolator 125 receives power from the transformer 115 and signals from the control panel 120 and generates a signal representative of the load type, high end trim, low end trim, and intensity level. Preferably, the signal that is outputted by the LVM isolator 125 is carried on three wires. The output of the isolator 125 is provided to LVMs 130 and 140 (which correspond to the LVMs in FIG. 1C). Each LVM 130, 140 has one input and preferably two outputs, with each of the outputs corresponding to a separate terminal that is controlled. Thus, for example, LVM 130 contains LVMs 1 and 2 from FIG. 1C, and LVM 140 contains two other LVMs from FIG. 1C.

The output signals from outputs 1 and 2 of the LVM 130 are provided to ballasts 135 and 136, respectively. The ballasts 135 and 136 receive power provided by the dimmer/relay card 150C or a constant voltage source S1 to drive the attached light sources or lamps 137 and 138, respectively. The ballast 135 has an internal relay or switch to turn the lamp 137 on and off. Thus, the ballast 135 is of the load type that has an internal relay or switch. The output signals from outputs 1 and 2 of the LVM 140 are provided to transformers 145 and 146, respectively. The transformers 145, 146 receive power from dimmer/relay cards 150A and 150B to drive attached light sources or lamps 147 and 148, respectively. Ballasts and transformers are interchangeable in the system of FIG. 2, and are used as appropriate with the attached light source and appropriate load type. Thus, each output 1 and 2 in the LVMs 130 and 140 can be configured to control any load type when used in conjunction with the correct ballast or transformer. In other words, preferably, each LVM can handle two zones, with each zone being any of the load types (e.g., 0 to 10 volts source or sink, PWM, DSI, etc.).

Figure 3:
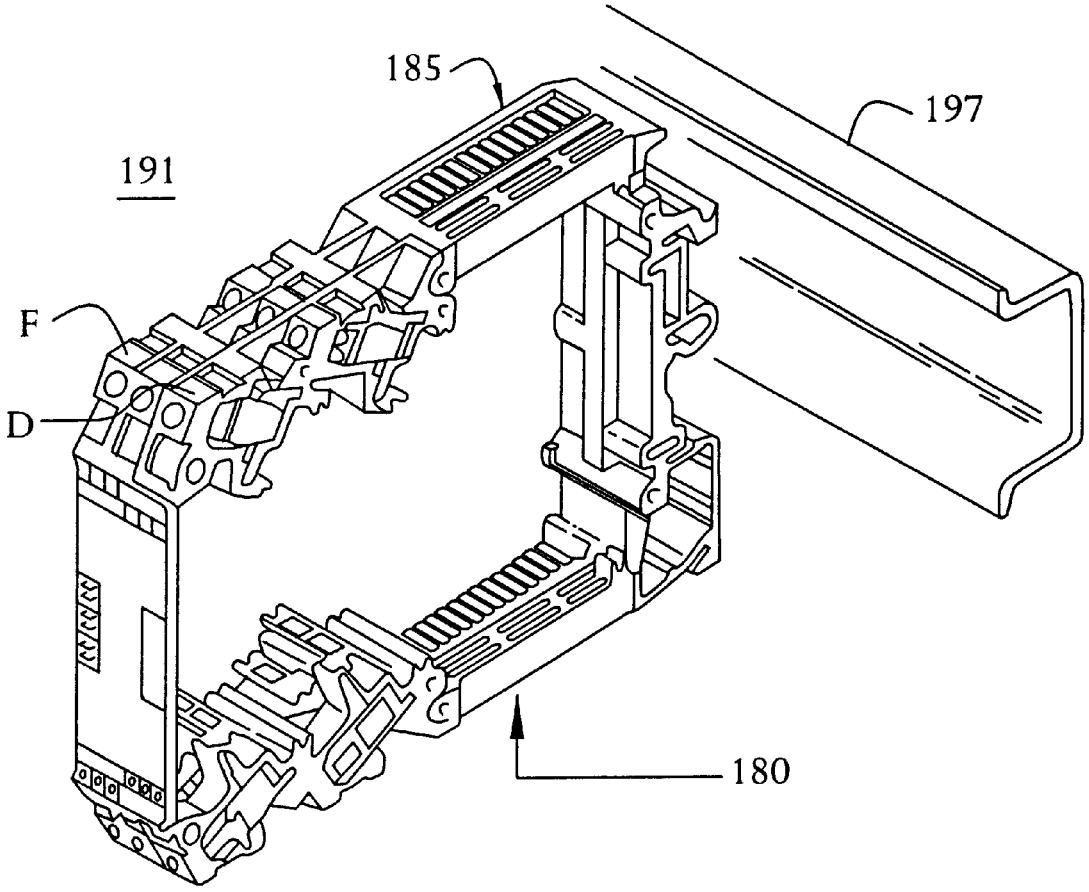
FIG. 3 is a perspective view of an exemplary low voltage module (LVM) isolator in accordance with the present invention.

FIG. 3 is a perspective view of an enclosure of an exemplary LVM isolator 191 in accordance with the present invention. A circuit board (not shown) solders to the terminals D and F and connectors 180 and 185 and holds the circuit components. A voltage (e.g., 12.3 volts AC) is received from the transformer 115 at input terminals D and F. Data from the circuit selector is received at a connector 180, preferably an 11 pin connector, preferably over two wires (data and common). Also shown is a connector 185, preferably an 11 pin connector, which preferably carries the output of the LVM isolator over three wires (data, common, and 18 volt DC). It should be noted that the common of the connector 180 is not tied to the common of the connector 185. A preferred enclosure is manufactured by Entretec under P/N PF11.0. In the preferred embodiment, the isolator enclosure is a different color than the LVM. The isolator serves to protect control panel CP from miswires at the ballast or transformer. It should be noted that the isolator is not a required element of the present invention.

Figure 4:
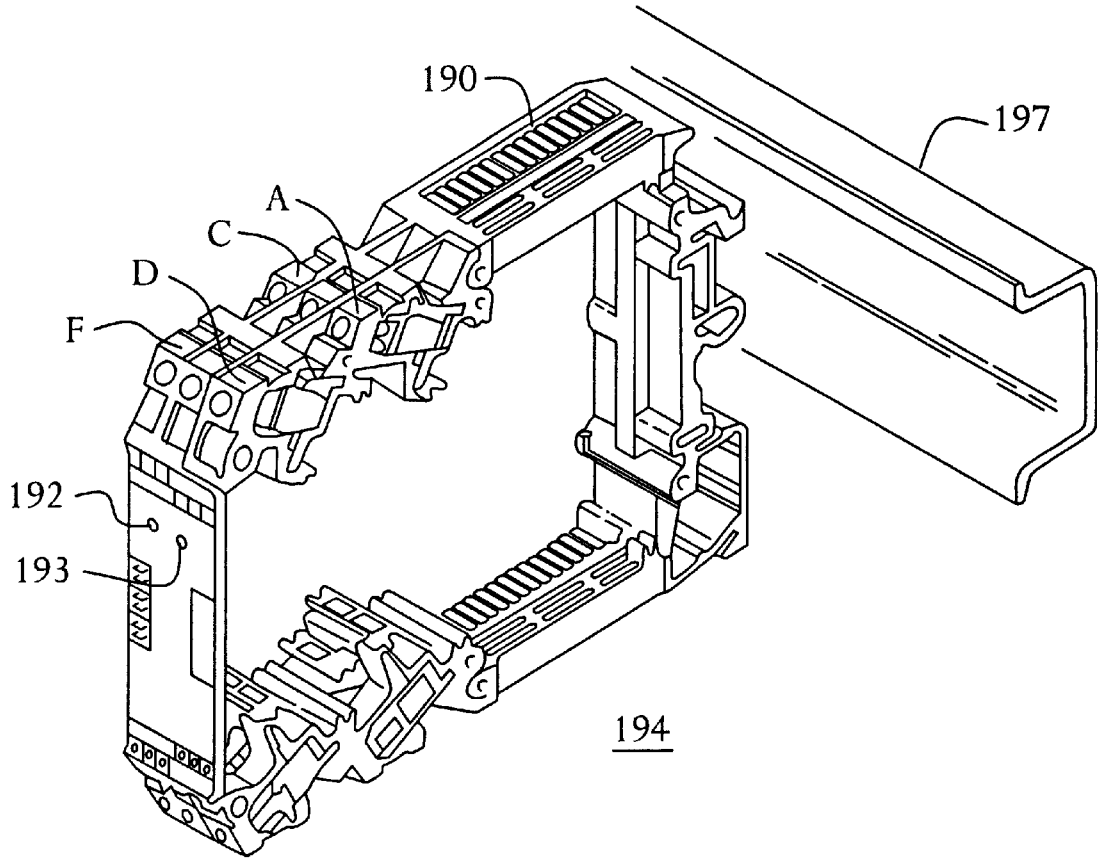
FIG. 4 is a perspective view of an exemplary LVM in accordance with the present invention.

FIG. 4 is a perspective view of an enclosure of an exemplary LVM 194 in accordance with the present invention (a circuit board is not shown). A connector 190, preferably an 11 pin connector, receives the data from the connector 185, preferably over three wires (data, common, and 18 volt DC). Also shown are LEDs 192, 193 which act as status indicators. The LVM 194 has output terminals A and C for output 1 and output terminals D and F for output 2. The module enclosures are designed to snap into a cooperating section of DIN rail 197.

Figure 4A:
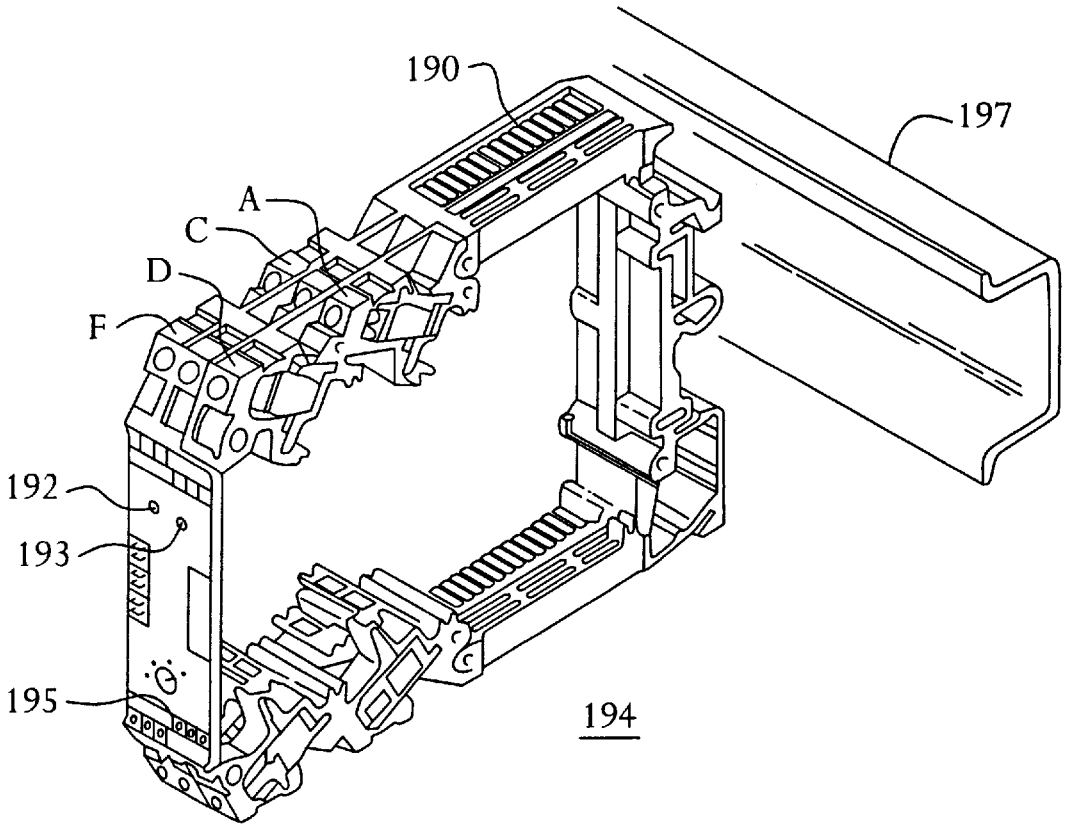
FIG. 4A is a perspective view of an alternative embodiment of the LVM in accordance with the present invention.

FIG. 4A shows an alternative embodiment of the present invention. A selector 195, shown as a rotary encoder switch, is located in the housing of the LVM. The selector is used to signal the microcontroller M1 (see description of FIG. 10D below) to configure its output to one of the at least four low voltage load types. The load type information is inputted in to the microcontroller M1 in conventional fashion from the selector. Other switches or equivalents can be used to signal the microcontroller, for example, a series of DIP switches or removable jumpers. The rotary encoder switch has at least four positions, each one corresponding to the different load types. In this embodiment, the LVM receives zone intensity, low end trim, and high end trim information from the control panel and load type information from the selector. The installer or the manufacturer simply rotates the rotary encoder switch or adjusts the DIP switches or jumper to a position corresponding to the load type to be connected to the LVM.

Figure 5:
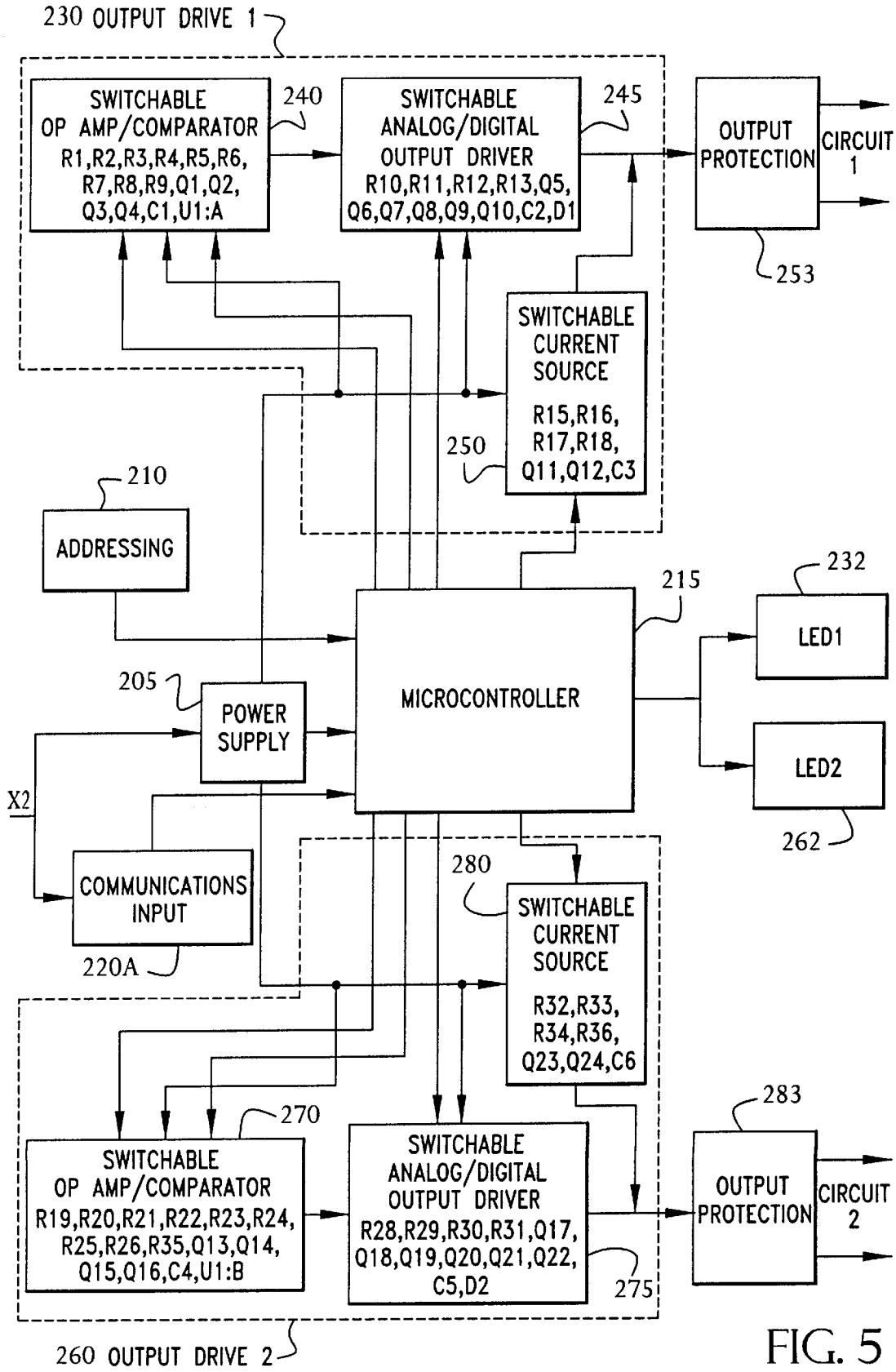
FIG. 5 is a block diagram of an exemplary LVM in accordance with the present invention.

FIG. 5 is a block diagram of an exemplary LVM in accordance with the present invention. FIG. 5 shows a power supply 205 that processes the power, e.g., about 5 volts DC and about 12 volts DC, that is supplied to a microcontroller 215 and the output circuits. Addressing element 210 is used to address the LVM. The microcontroller 215 is preferably a PIC16C63 microprocessor made by Microchip. The microcontroller preferably comprises a CPU, a power-on reset, a watchdog timer with isolated on-chip oscillator, an operating range of between about 2.5 and about 6 volts, two 8 bit timers and one 16 bit timer with prescalers and interrupt drivers, 16 bit event capture, 16 bit compare, a PWM module, and a universal synchronous/asynchronous receiver/transmitter (USART). The microcontroller preferably comprises two channels of output compare or PWM generation.

The USART capability is used to communicate to the control panel through communications input 220A at X2, shown in FIG. 1C. The PWM generation capability is used to generate analog signals (e.g., 0 to 10 volt and PWM). The microcontroller 215 controls two outputs 230 and 260 of an LVM, similar to LVM 130 described in FIG. 2. The output compares are used to generate digital outputs (e.g., DSI). The communications input 220A reads the control panel input and provides it to the microcontroller 215.

A DSI packet consists of 21 bits, each approximately 833 $\mu$s long. The packet has one start bit and four stop bits. All the start and stop bits are low. The data itself is an 8 bit word sent in Manchester code: the bit followed by its inverse. The 8 bit data word is calculated using the zone intensity, low end trim and high end trim information sent by the circuit selector, by the appropriate output routines, such as that shown in element 415 in FIG. 7. The data packet is sent out by the microcontroller using the output compare function. The compare is set to generate an interrupt approximately every 833 $\mu$s. The compare interrupt service routine uses a counter to keep track of which bit is being sent. If the bit is a start or a stop bit, the output port is set high (the output drive inverts the logic of the signal). If one of the data bytes is being sent, the appropriate bit in the data word generated by the output routine is looked at. The bit or its inverse determines the status of the output port. When the end of the data packet is reached, the routine turns the compare interrupts off and resets the counter. The output routines turn the compare back on when another packet is to be sent.

The exemplary system shows two zones or outputs, driven by output drives 230, 260, respectively. Each output drive 230, 260 comprises a switchable op-amp/comparator 240, 270 which is selectively driven as an op-amp or a comparator depending on the load type, as described in further detail below with respect to FIGS. 10A–10F. For switching waveforms such as PWM and DSI, the device 240, 270 is operated as a comparator, and for analog signals, such as 0 to 10 volt, the device 240, 270 is operated as an op-amp. Each output drive 230, 260 further comprises a switchable digital/analog output drive 245, 275 and a switchable current source 250, 280, which are further described below.

The LED circuits 232, 262, which include LEDs 192, 193 in FIG. 4, are used to convey diagnostic information regarding zones 1 and 2 (i.e., outputs 1 and 2), respectively. Output protectors 253, 283 are also provided before the signals are sent to the output circuits 1 and 2. An over-voltage protection scheme can be used to detect and protect against single and two wire miswires to line voltage. Single line miswires are either of the two output wires being tied to Hot or Neutral, and two wire miswires have one of the output wires tied to Hot and the other connected to Neutral.

Figure 6:
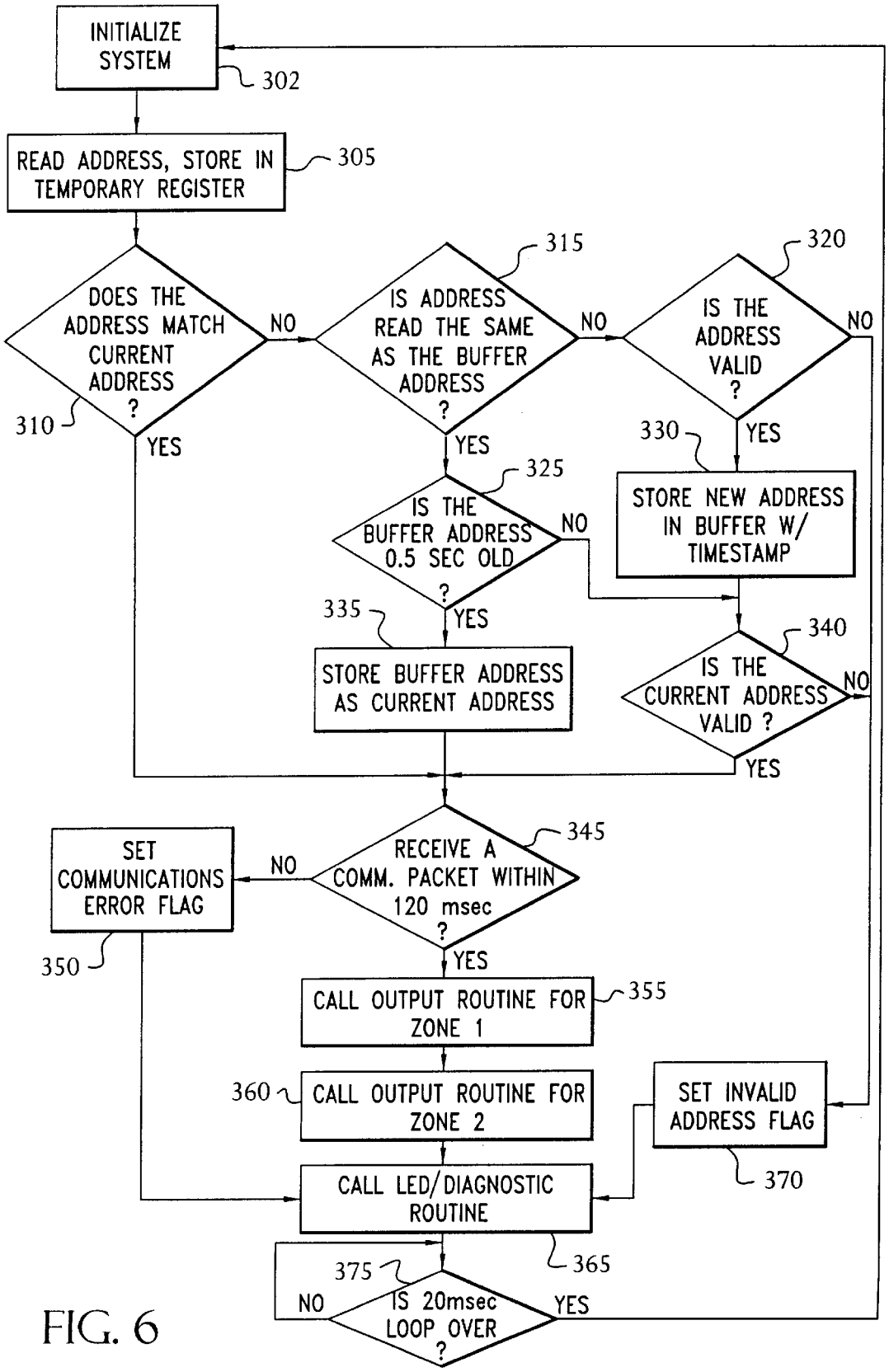
FIG. 6 is a flow diagram of an exemplary LVM main loop procedure in accordance with the present invention.

FIG. 6 is a flow diagram of an exemplary LVM main loop procedure in accordance with the present invention. As described in further detail below, a main loop sets the address, controls the status (LED) indicators, determines whether new data has been received, calls the output routines, determines the communication baud rate, and waits for the end of a preset time (preferably about 20 ms) and repeats. A communications routine checks for a start byte, and if valid, resets a counter. The counter is incremented and added to the checksum. The data is stored in a temporary memory and then stored permanently. The address and baud rate calculations apply to both zones controlled by the microcontroller in the LVM. The status control, new data determination, and output routine calling are duplicated for an LVM that controls two zones; in a preferred embodiment, one set controls zone 1 and the other set controls zone 2.

The addressing routine checks the value of the address input port and latches this value. Using an incremental counter, the microcontroller checks this port for a predetermined number of main loop cycles (e.g., 25 cycles) or a predetermined time (e.g., about 500 ms), and if the value remains constant, sets the address of the microcontroller to that value. If that value is a valid address, the addressing error indicator is cleared. The addressing routine continues to check the current address against the value of the address input port. If the two differ at any time during execution, the previous cycle is again initiated. If the latched address is an invalid value, the LED driver is set to indicate this, and the routine will continue to test for a valid address upon the next cycle of the main loop.

More specifically, the system is initialized at step 302 by setting the initial parameters, as shown in FIG. 6. Specifically, the current unit address is set equal to 0 and the buffer is emptied or zeroed. The system then reads the address ports at step 305 and stores the unit address in a temporary register. The address ports can be set using DIP switches, a rotary encoder, or preferably a multiple pin connector with certain pins tied together. In the preferred embodiment, the multiple pin connectors are interconnected through a harness so that each unit will receive a unique address when connected, based on its position on the harness.

After the unit address is read and stored, it is compared at step 310 to the current unit address to determine if the unit address is being changed. In other words, an old address value is compared with a new address value. Preferably, the system will not respond to an address change until the new address is stable for a predetermined time, such as about 0.5 seconds. This is helpful when a rotary encoder is used to set the unit address, because to go from address 1 to address 12, the rotary encoder goes through all the intermediary positions. As the rotary encoder is rotated from one position to the next, the system stores the new value in a buffer. The first time through the loop the addresses will not match because the current address is equal to zero and the address from step 305 will not equal zero. In this case, processing continues at step 315. If the new unit address matches the current (i.e., old) address, processing continues at step 345, as described below.

At step 315, the system checks to determine if the address from step 305 (which is stored in a temporary register) equals the buffer address. If the addresses are equal, processing continues at step 325, as described below. The first time through the loop the buffer will not have a value, so the addresses will not be equal and processing continues at step 320. At step 320, the system checks if the address from step 305 is a valid address. If the system determines that the address is valid, the system proceeds to step 330, as described below. If not, the system will proceed to step 370. At step 370, the system sets an invalid address flag. This can occur, for example, if the harness was made incorrectly. The default address for a module not properly connected to a harness is zero. Processing continues at step 365, as described below.

At step 330, the system stores the address from step 305 in the buffer and time stamps the address. The system then determines, at step 340, if the current address is a valid address. If the current address is not valid, the system proceeds to step 370 and sets an invalid address flag. If current address is valid, processing continues at step 345.

At step 365, the system calls a diagnostic routine, preferably an LED diagnostic routine. A status indicator LED is used to give feedback to the user about the system's condition. In the preferred embodiment, the module has two LEDs, one for each zone or output. Processing continues at step 375 where the system waits a predetermined amount of time until the loop is over (e.g., 20 ms). This ensures that each loop takes the same amount of time. Processing then returns to step 302.

The second time through the loop there will be a value in the buffer and if there are no changes to the unit address, the processing proceeds to step 315. At step 315, the new address from step 305 will equal the buffer, and processing continues at step 325.

At step 325, the system checks to determine if the value in the buffer has remained the same for at least at predetermined amount of time, preferably about 0.5 seconds (which equals about 25 times through the loop). If not, processing continues at step 340. If the value in the buffer has remained the same for at least the predetermined amount of time, at step 335, the system stores the buffer address as the current address and proceeds to step 345. At step 345, the system checks to see if a communication packet has been received in, for example, about the last 120 ms. If not (this can occur if the incoming signal is removed), processing continues at step 350. At step 350, the system sets a communications error flag and proceeds to step 365. If the system has received a communication packet in, for example, about the last 120 ms, the system calls the output routine for zone 1 at step 355 and calls the output routine for zone 2, at step 360. Processing then continues at step 365, as described above. It should be noted that FIG. 6 is directed to an LVM module that controls two output devices/light sources (zone 1 and zone 2). It is contemplated that an LVM module can control any number of output devices/light sources, such as one, three, or greater.

In a preferred embodiment, the LVM is initially set to communicate at about 41 kHz. If 48 framing errors are received before a valid checksum calculation, the baud rate is changed to about 7.8 kHz. If another 48 framing errors are received, the baud rate is switched back to about 41 kHz. The loop continues until valid communication is achieved. Each valid packet resets the framing error counter.

An interrupt driven function is the primary interface between LVM and control panel. Preferably, the function is called on every port receive interrupt. The function waits for receipt of a valid start byte. If no valid start byte is received within a predetermined time, e.g., about 120 ms, a communications error is signaled. When a valid start byte is received, the function uses various counters to determine what address the latched data is destined for and what type of data has been latched to the port. Once the data format has been determined, and only if the incoming address is that of the microcontroller, the value is stored in the appropriate temporary variable, and the checksum value is updated. If the address is not that of the microcontroller, the checksum value is updated but the data is not recorded. If valid checksum data is received at the end of the communications packet, the data in the temporary variables is stored to the appropriate registers to be used by the output routines in calculating light levels. If the checksum data is invalid or if no checksum data is received, the data is deleted and the function looks for a new start byte.

Preferably, an 8 bit timer is used as a reference for main loop timing. The clock resets periodically (e.g., about every 16 ms) and signals an interrupt when it does so. Once this interrupt is received, a counter counts down a predetermined time (e.g., about 4 ms) and then resets the loop.

A output compare is used to generate DSI outputs. Preferably, the compare module checks for matches between a 16 bit free running timer and a register. When a match is found, an interrupt is triggered and a service routine is called.

A watch dog timer is set to a predetermined period (e.g., about 18 ms). The timer is reset a predetermined number of times (e.g., twice) during each main loop cycle. A timer overflow causes a system reset.

Figure 7:
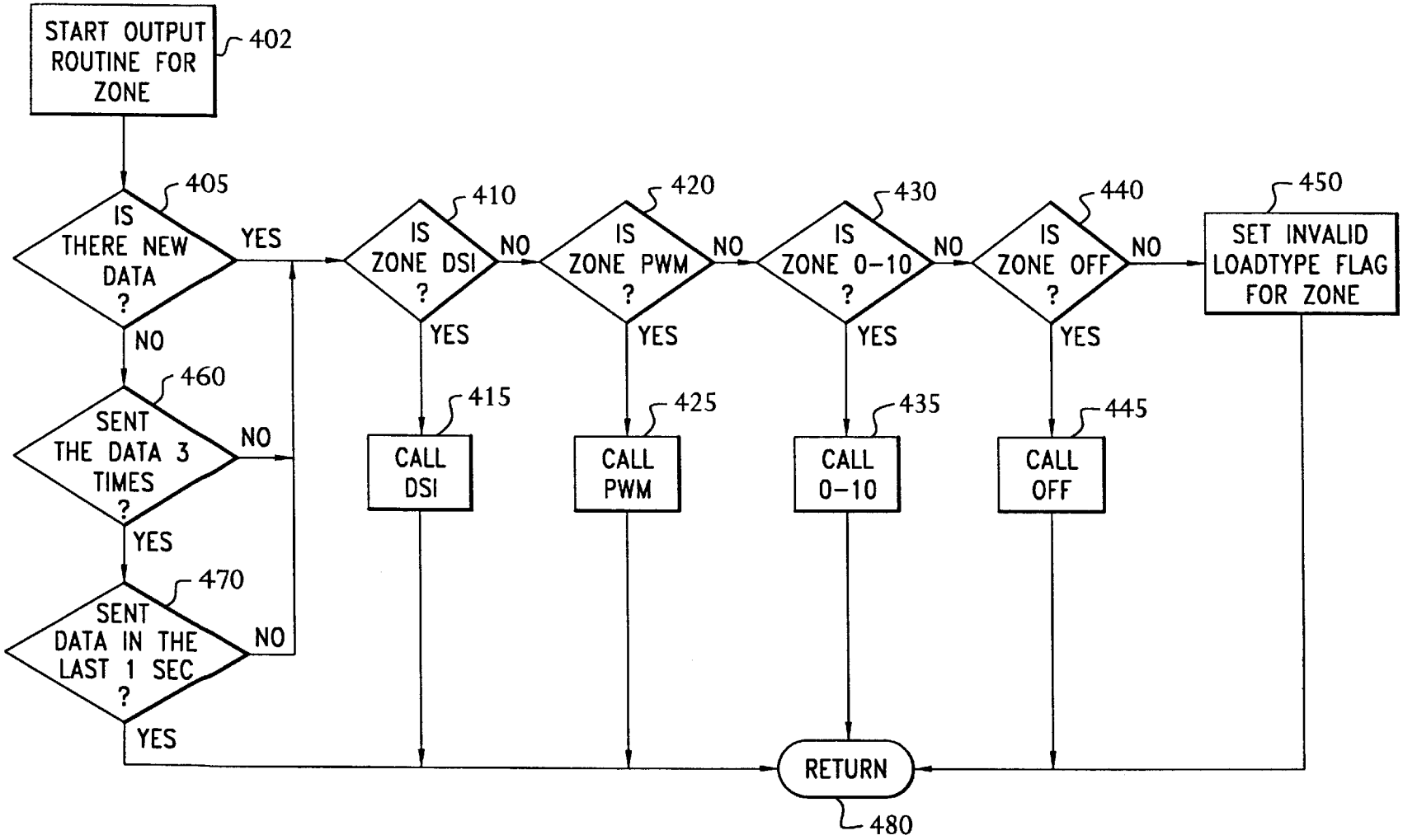
FIG. 7 is a flow diagram of an exemplary output routine for a LVM in accordance with the present invention.

FIG. 7 is a flow diagram of an exemplary output routine for an LVM in accordance with the present invention. The description given herein is for controlling one zone in the LVM. The same action is taken for any other zone that the LVM is controlling; of course, different output ports will be used to control different zones or light sources. The output routine sets a port value and then performs the appropriate output formatting and controlling. When new data is received, or when new data has not been received for a predetermined time (e.g., 1 s), the main loop is flagged to call the appropriate output routine, determined by the value of the load type data for the applicable zone. Each output routine, one for PWM zone 1, one for PWM zone 2, one for DSI zone 1, etc., uses the stored intensity value, high end trim, and low end trim to compute a scaled intensity.

At step 402, the output routine for the particular zone is called. At step 405, it is determined whether new data is provided. If not, it is determined if the data has been sent a predetermined number of times, for example, three times, at step 460. If the data has been sent the predetermined number of times, it is determined at step 470 if the data has been sent in the last, for example, about 1 s. If the data has been sent in the last, for example, about 1 s, the routine exits and returns at step 480.

If, at step 405, it is determined that the data is new, or if, at step 460, it is determined that the data has not been sent the predetermined number of times, or if, at step 470, it is determined that the data has not been sent in the last, for example, about 1 s, then the data is checked to determine the load type of the corresponding zone. For example, at step 410 it is checked to determine if the load type is DSI, at step 420 it is checked to determine if the load type is PWM, and at step 430 it is checked to determine if the load type is 0 to 10 volt. Responsive to the load type, the appropriate load type output formatting routine is called: DSI is called at step 415, PWM is called at step 425, and 0 to 10 volt is called at step 435. If the zone is determined to be off, at step 440, an off routine is called at step 445. If the zone is not any of the predetermined load types such as PWM, DSI, or 0 to 10 volt, and is not off, then at 450, an invalid load type flag is set.

Regarding the formatting output routines, in the case of PWM and 0 to 10 volt, the intensity is scaled from a 7 bit number (the value received from the circuit selector) to a 10 bit number (the value used by the PWM circuit) and determines the duty cycle of the PWM circuit. In the case of DSI, the intensity is scaled from a 7 bit number to an 8 bit number and determines the value that will be Manchester encoded and sent to the DSI ballast.

Figure 8:
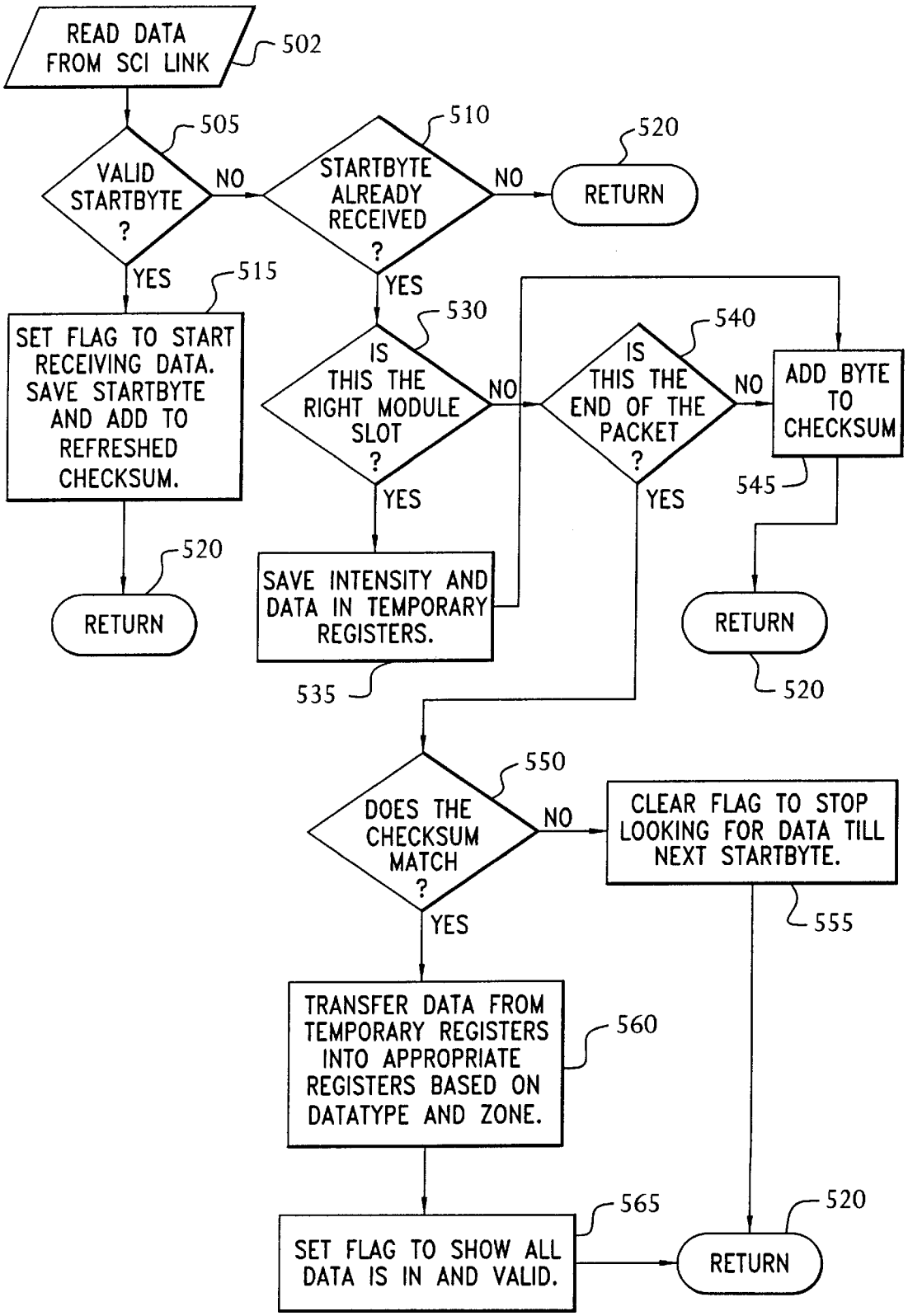
FIG. 8 is a flow diagram of an exemplary interrupt routine for a LVM in accordance with the present invention.

FIG. 8 is a flow diagram of an exemplary interrupt routine for an LVM in accordance with the present invention. Interrupt routines handle the communications link between the LVM and the circuit selector, main loop timing, and DSI signal generation. The interrupt driven communications routine sets a new data flag whenever a received data or intensity byte is different from the current value. When this flag is set, preferably the main control loop will substantially immediately begin the appropriate output routines.

The interrupt routine begins by reading data from the SCI link at step 502. The data is checked for a valid start byte at step 505. If the start byte is valid, then, at step 515, a flag is set to start receiving data, and the start byte is saved and added to the refreshed checksum. Processing then continues at step 520 by returning to the routine that called the interrupt routine.

If the start byte at step 505 is not valid, it is determined at step 510 if the start byte has already been received. If the start byte has not already been received, then processing continues at step 520 by returning to the routine that called the interrupt routine. If the start byte has already been received, then the module slot is checked to determine if it is correct at step 530. If the module slot is correct, then the intensity and data are stored in temporary registers at step 535, the byte is added to the checksum at step 545, and processing continues at step 520 by returning to the routine that called the interrupt routine.

If the module slot at step 530 is not correct, then it is determined at step 540 if the packet has ended. If not, the byte is added to the checksum at step 545, and processing continues at step 520 by returning to the routine that called the interrupt routine. If the packet has ended, then the checksum is checked at step 550 to determine if it matches.

If the checksum does not match at step 550, then at step 555, the flag is cleared to stop looking for data until the next start byte. Processing continues at step 520 by returning to the routine that called the interrupt routine.

If the checksum does match at step 550, then at step 560, data is transferred from the temporary registers to appropriate registers based on the data type and the zone. A flag is set at step 565 to indicate that all data has been received and is valid. Processing continues at step 520 by returning to the routine that called the interrupt routine.

Figure 9:
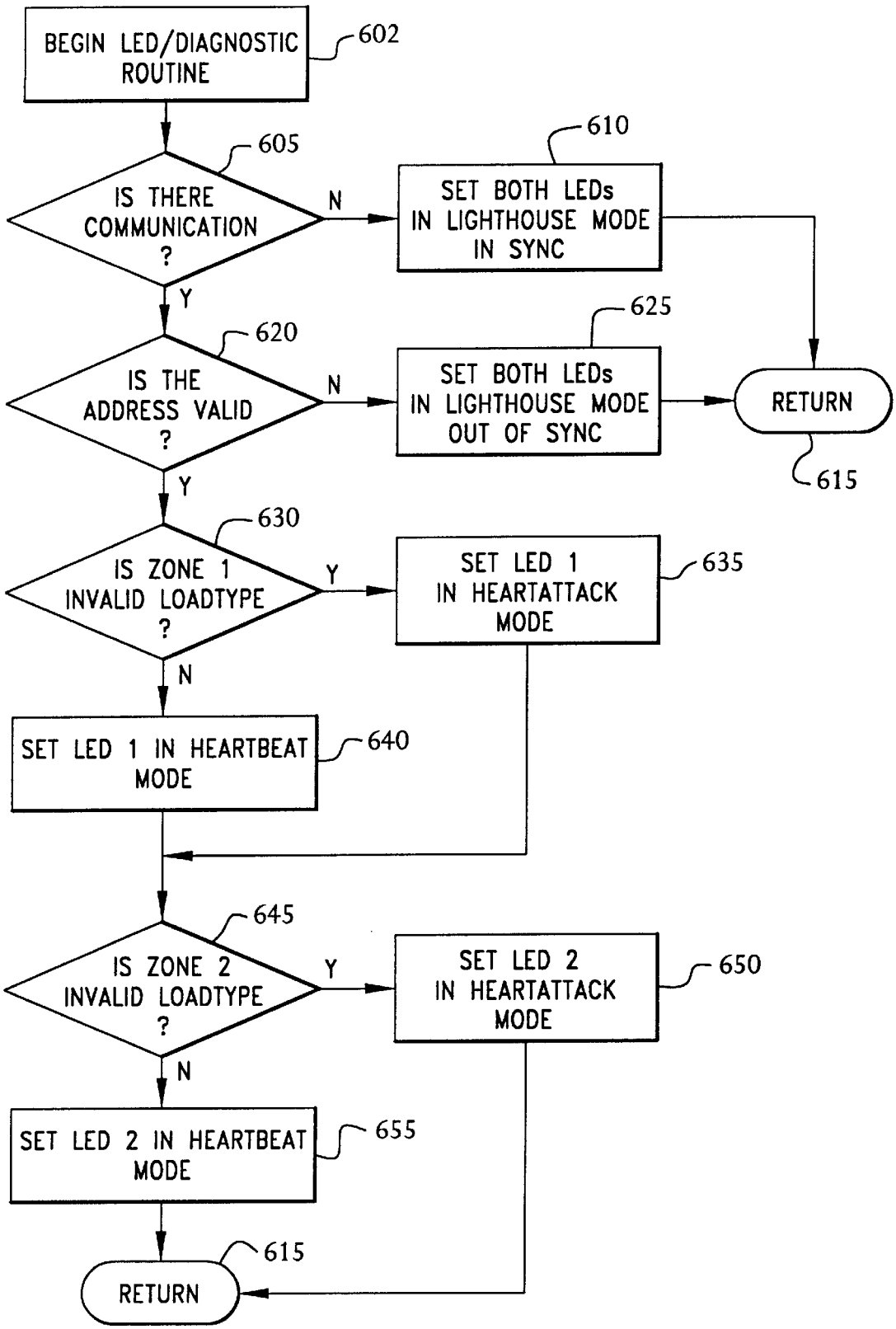
FIG. 9 is a flow diagram of an exemplary diagnostic routine in accordance with the present invention.

FIG. 9 is a flow diagram of an exemplary diagnostic routine in accordance with the present invention. In the preferred embodiment, the status of an LVM which controls the intensity level of two zones/light sources is indicated by two LEDs, one for each zone (shown as LEDs 192, 193 in FIG. 4). The LED mode is determined by error flag bits set in various routines. The LEDs preferably exist in one of four modes: (1) heart beat—normal operation, no errors encountered, (2) lighthouse (in sync)—communication error when no valid checksum information is received for a predetermined length of time (e.g., about 120 ms), (3) light-house (out of sync)—address error, and (4) heart attack—load type error set on the reception of an invalid load type. In heart beat mode, the indicator (LED) is preferably on for about ¼ second and off for about ¾ second and repeats. In lighthouse mode, the indicator is preferably on for about 3 seconds and off for about 5 seconds and repeats. In lighthouse mode, the two LEDs can either be in sync or out of sync. In heart attack mode, the indicator is preferably on for about ⅛ second and off for about ⅛ second and repeats.

At step 602, the diagnostic routine is called. It is determined at step 605 if there is communication. If there is communication, then it is determined at step 620 if the address is valid. If there is no communication or if the address is invalid, then both LEDs are set in lighthouse mode, in sync and out of sync, respectively, at steps 610 and 625. Processing continues at step 615 by returning to the routine that called the diagnostic routine.

If the address is valid at step 620, then at step 630 it is determined if the load type for the light source/zone (zone 1) is invalid. If the load type is invalid, then the LED (LED 1) is set to heart attack mode at step 635; otherwise the LED is set to heart beat mode at step 640. At step 645, it is determined if the load type for the second light source/zone (zone 2) is invalid. If the load type is invalid, then the LED (LED 2) is set to heart attack mode at step 650; otherwise the LED is set to heart beat mode at step 655. Processing continues at step 615 by returning to the routine that called the diagnostic routine.

Figure 10A:
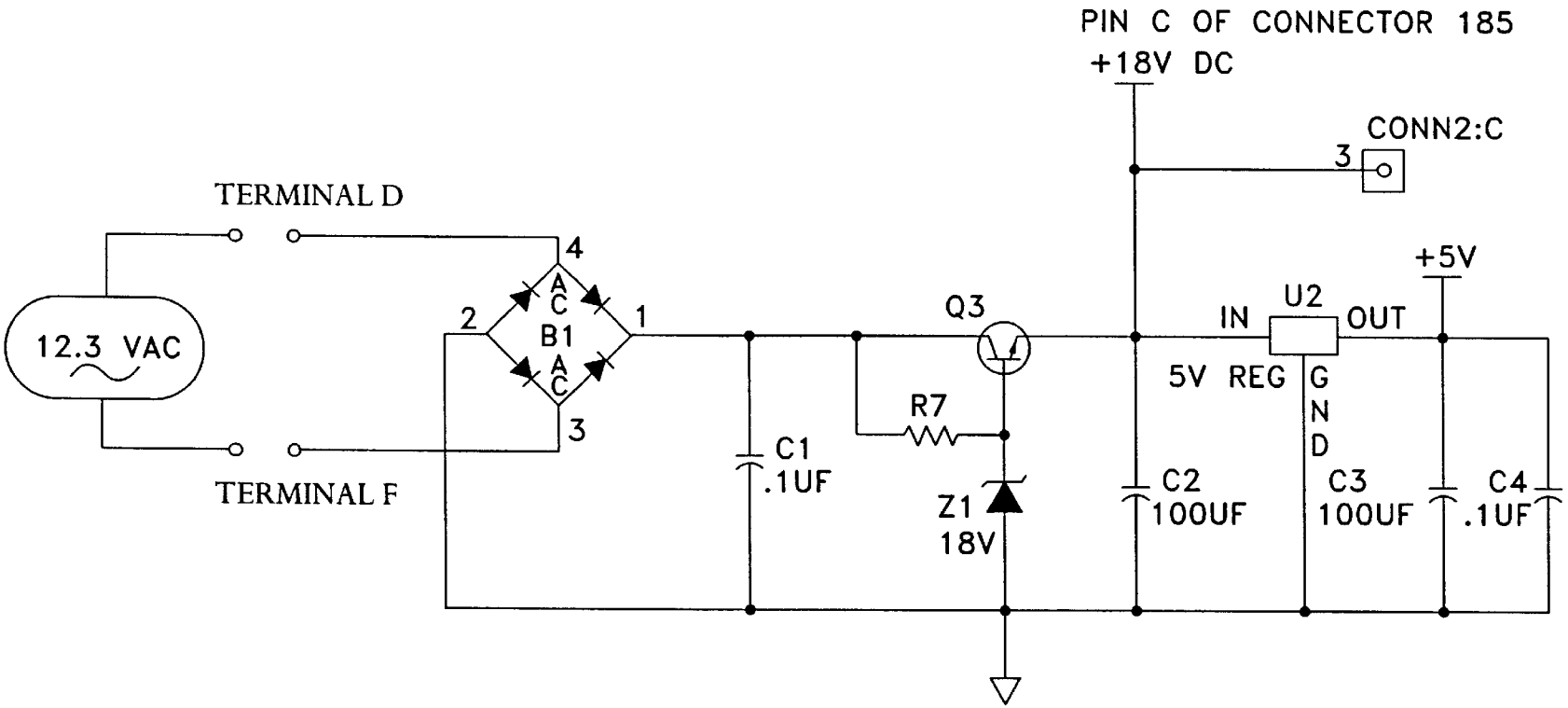
FIGS. 10A to 10F are electrical schematics showing preferred circuitry for implementing various aspects of the present invention.
Figure 10B:
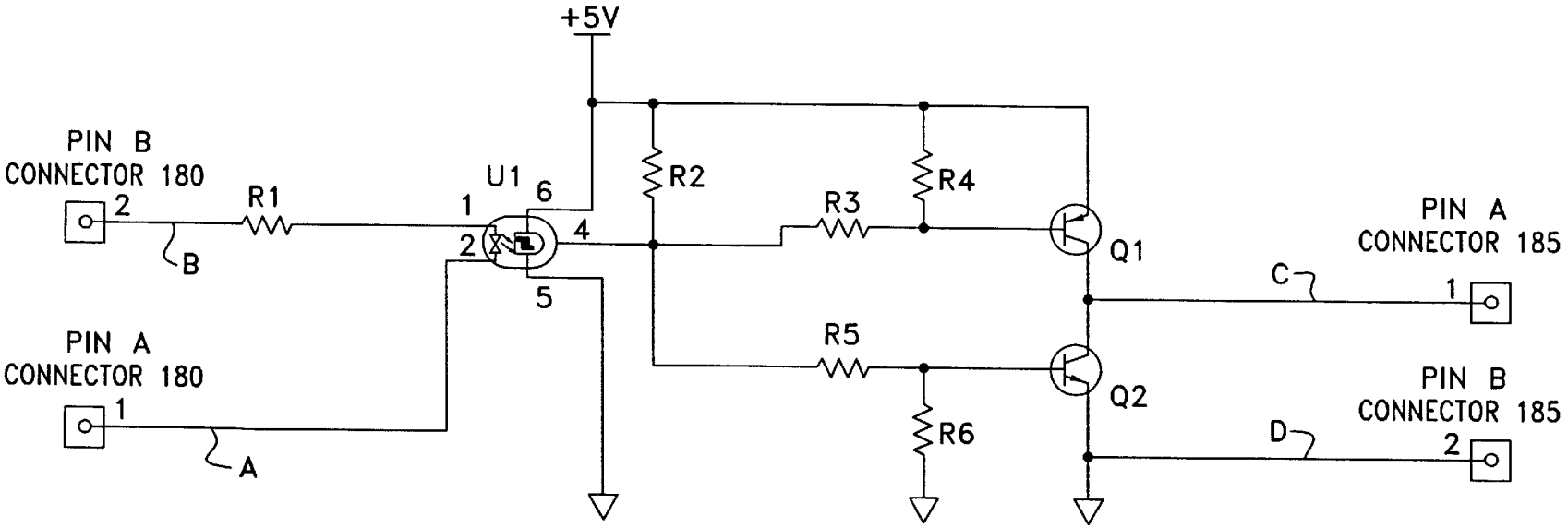

FIGS. 10A to 10F are electrical schematics showing preferred circuitry for implementing various aspects of the present invention. Like reference numerals in FIGS. 10A and 10B may not indicate like components in FIGS. 10C, 10D, 10E, and 10F. FIG. 10A is an exemplary circuit of an LVM isolator which receives about 12.3 volts AC and outputs 18 volts DC, and FIG. 10B is a circuit used to optically isolate the data in the LVM isolator. In FIG. 10B, the wires A and C carry data, and the wires B and D are common.

FIG. 10A shows the power supply section of the LVM isolator 125 of FIG. 2. About 12.3 volts enters the isolator from transformer 115, shown in FIG. 2, through terminals D and F, shown in FIG. 3. The output of the LVM isolator is about 18 volts DC through pins B and C of connector 185. The power supply also generates about 5 volts DC for use in FIG. 10B.

FIG. 10B shows the optical isolation provided by optocoupler U1. Data comes in from the control panel 120 shown in FIG. 2 through pins A and B of connector 180 shown in FIG. 3. The optically isolated data exits the isolator 125 through pins A and B of connector 185 shown in FIG. 3.

Figure 10C:
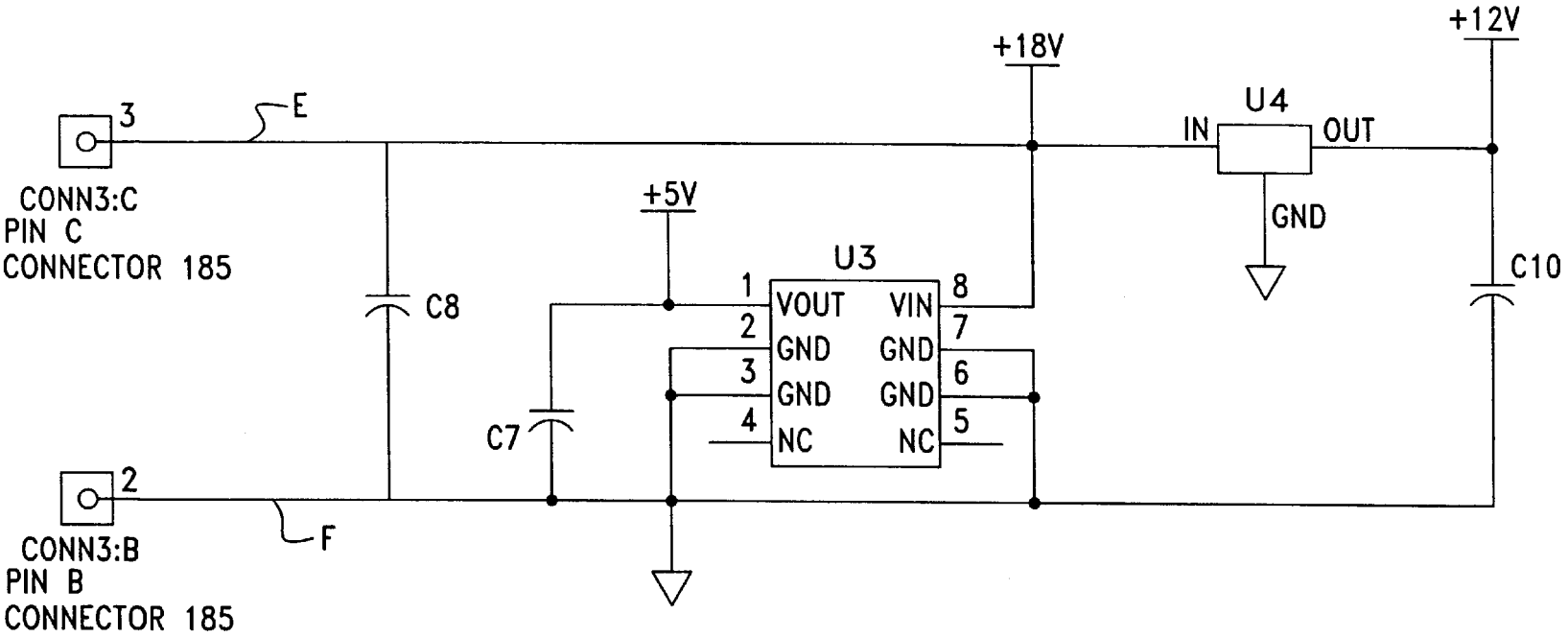

FIG. 10C is a circuit of a power supply (corresponding to element 205 in FIG. 5). The power supply has an 18 volt input, and outputs 5 and 12 volts. In FIG. 10C, wire E is connected to 18 volts DC and wire F is connected to common. The power supply comprises capacitors C7, C8, and C10 and linear regulators U3 and U4.

Figure 10D:
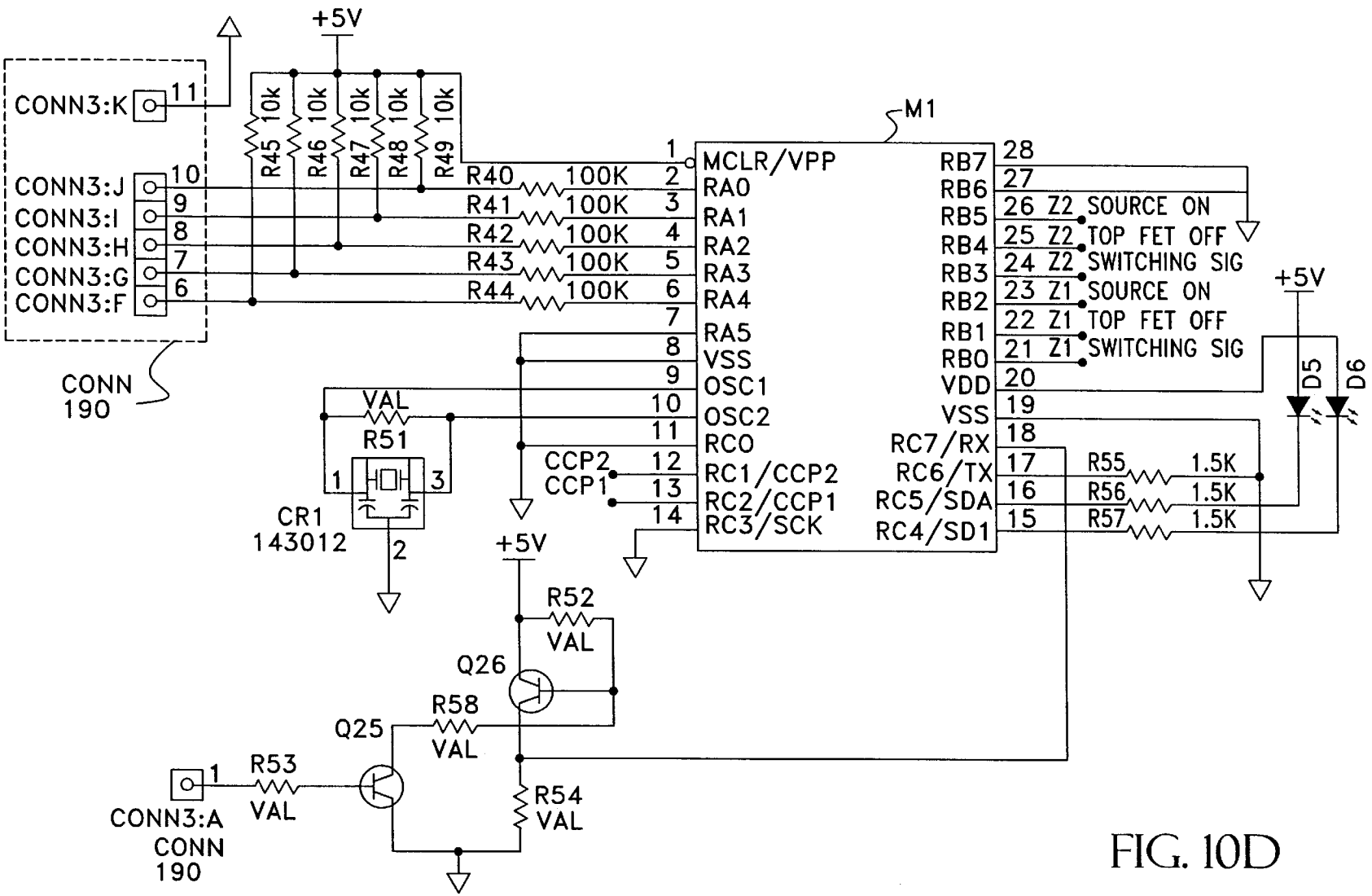

FIG. 10D is a circuit of the addressing block and microcontroller (corresponding to elements 210 and 215 in FIG. 5) as well as the communications input (element 220A in FIG. 5). In FIG. 10D, connector CONN 190 is preferably an 11 pin connector that receives the input to the LVM, and diodes D5 and D6, along with resistors R56 and R57, respectively, are the status indicator LEDs described above (e.g., LEDs 192 and 193 in FIG. 4). The addressing block comprising resistors R40–R49. The microcontroller M1 is further connected to resistors R51 and R55, and crystal CR1. The communications input comprises resistors R52–R54 and R58 and transistors Q25 and Q26.

The microcontroller Ml reads the address from the connector 190 by determining which of the pins F, G, H, I, and J are connected to pin K (common). Microcontroller M1 also drives the diagnostic LEDs 192 and 193, which are schematically shown as D5 and D6. The microcontroller M1 is powered by about 5 volts DC from FIG. 10C. FIG. 10D also shows resistors R52, R53, R54, R58, transistors Q25 and Q26 which square up the incoming data signal from the connector 190.

Figure 10E:
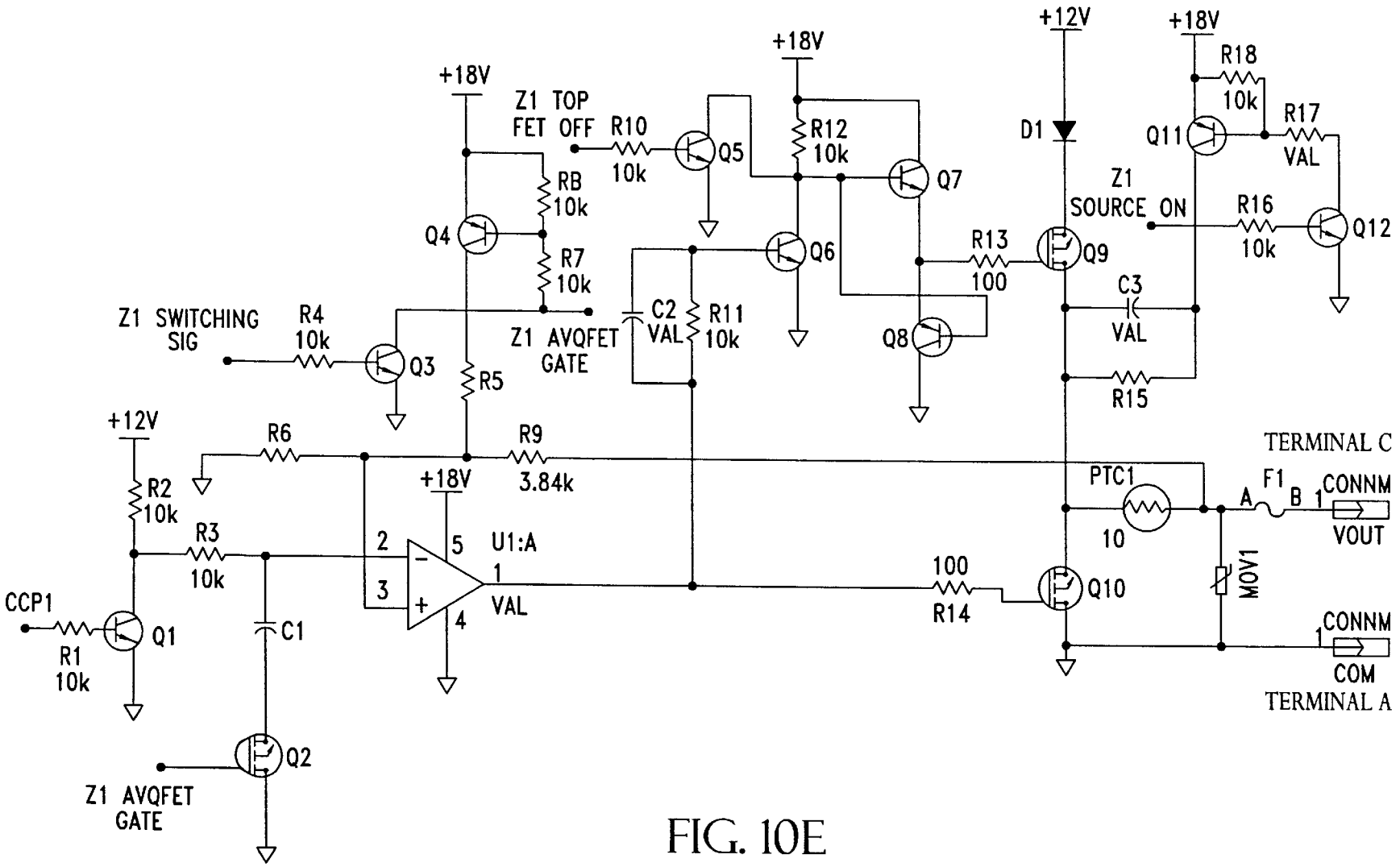

FIG. 10E is a circuit of one of the outputs of an LVM, e.g., output 1 in LVM 130 in FIG. 2 and block 230 in FIG. 5. In FIG. 10E, a switchable op-amp/comparator, similar to element 240 in FIG. 5, comprises resistors R1–R9, transistors Q1–Q4, capacitor C1, and op-amp U1:A. As described above, U1:A is selectively driven as an op-amp or acomparator depending on the load type. For switching waveforms (PWM and DSI), U1:A is operated as a comparator by turning transistor Q3 on. This presents a DC voltage (preferably about 9 volts) at the non-inverting pin of the op-amp U1:A, forcing the op-amp U1:A to act as a comparator. The output of the microprocessor is presented and inverted at the inverting pin by Q1. For non-switching signals (e.g., 0 to 10 volt), transistor Q3 is turned off. Capacitor C1 sets an analog voltage at the inverting pin of the op-amp U1:A. The resistor combination R6/R9 form a feedback loop for the op-amp U1:A to regulate a DC voltage at the output pin. Resistors R2 and R3 and capacitor C1 are selected to provide an integration (DC) signal from the PWM microcontroller output and an appropriately linear transfer curve.

In FIG. 10E, a switchable digital/analog output driver, similar to element 245 in FIG. 5, comprises resistors R10–R14, transistors Q5–Q10, capacitor C2, and diode D1. In the case in which the load type uses a switching waveform (e.g., PWM and DSI), transistor Q5 is turned off, thereby forcing transistors Q9 and Q10 to act like complementary transistors. Because the op-amp U1:A acts like a comparator with these load types, as described above, the output of the op-amp U1:A transitions between two predetermined values, preferably about 0 and about 18 volts. This allows the output to be a time varying waveform between two values set by the microcontroller, preferably about 0 and about 12 volts. In the case in which the load type uses a non-switching waveform (e.g., 0 to 10 volt), the transistor Q5 is turned on, which forces transistor Q9 to remain off. This allows the op-amp U1:A to control the voltage at the drain of transistor Q10 using the feedback loop.

In FIG. 10E, a switchable current source, similar to element 250 in FIG. 5, comprises resistors R15–R18, transistors Q11 and Q12, and capacitor C3. Current is sourced through transistor Q11 and resistor R15 when transistor Q12 is turned on. Transistor Q12 is turned on while performing non-switching load types, such as 0 to 10 volt. Metal oxide varistor (MOV1), fuse F1, and positive temperature coefficient PTC1 are used to protect the LVM against miswires on the load side of the module.

Figure 10F:
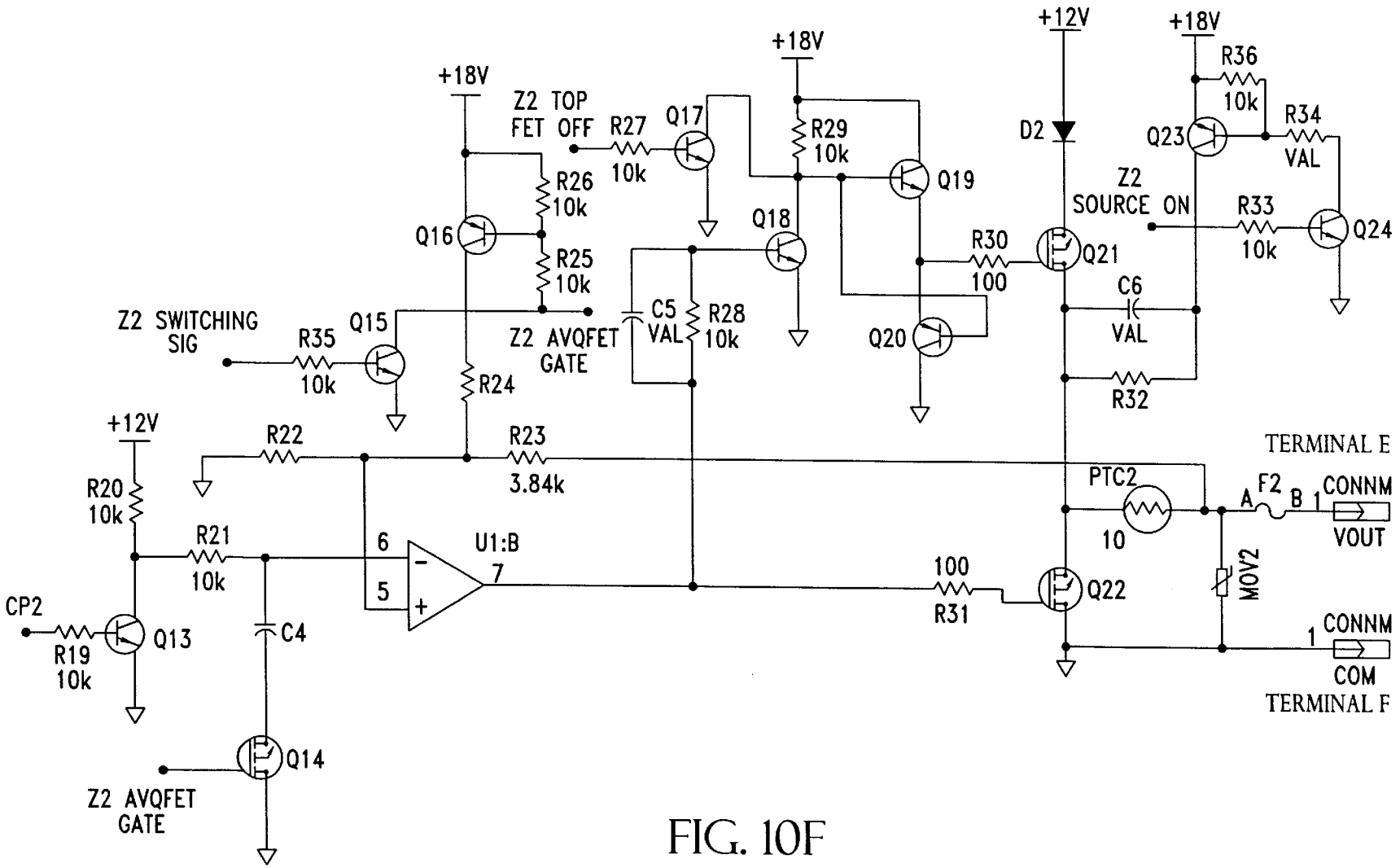

FIG. 10F is a circuit of another of the outputs of an LVM, e.g., output 2 in LVM 130 in FIG. 2, and comprises circuit elements similar to those discussed above with respect to FIG. 10E. A switchable op-amp/comparator, similar to element 270 in FIG. 5, comprises resistors R19–R26 and R35, transistors Q13–Q16, capacitor C4, and op-amp U1:B. A switchable digital/analog output driver, similar to element 275 in FIG. 5, comprises resistors R27–R31, transistors Q17–Q22, capacitor C5, and diode D2. A switchable current source, similar to element 280 in FIG. 5, comprises resistors R32–R34 and R36, transistors Q23 and Q24, and capacitor C6. These circuit elements operate similar to those described above with respect to FIG. 10E, and thus their descriptions are omitted for brevity.

For a 0 to 10 volt sink or source load type, with reference to FIGS. 10D and 10E, the output routine of the microcontroller turns transistor Q3 off by keeping port RB0 low. Transistor Q5 is turned on by pulling port RB1 high. Transistor Q12 is turned on by pulling RB2 high. Transistor Q3 turns transistor Q2 on and transistor Q4 off. The turning on of Q2 connects capacitor C1 to ground, thereby bringing it into the circuit. Transistor Q5 turns transistor Q8 on and transistor Q9 off. Transistor Q12 turns transistor Q11 on. The turning on of Q11 starts a weak current source through resistor R15 and brings capacitor C3 into the circuit. Capacitor C3 stabilizes the 0 to 10 volt output. The hardware PWM of the microprocessor U2 is used to generate a PWM at the base of transistor Q1 through the port RC1. This PWM generates a DC voltage using the averaging capacitor C1 at the inverting pin of the op-amp U1:A. The op-amp U1:A, using transistor Q10 and the feedback loop resistors R6 and R9, sets a corresponding DC voltage at the output, which is a fixed function of the voltage on the capacitor C1.

The input signal at the base of transistor Q1 is a pulse width modulated square wave which controls the on-off states of transistor Q1. When transistor Q1 is on, the voltage across capacitor C1 is close to 0 volts. When transistor Q1 is off, the voltage across transistor Q1 is preferably about 12 volts. The duty cycle of the PWM determines the DC voltage across capacitor C1. The op-amp U1:A with the feedback loop, which includes resistors R6 and R9, then determines the value of VGS and thus RDS. The opamp U1:A sets RDS such that the output voltage is a fixed function of the DC voltage across capacitor C1. This function is determined by the resistance division formed by the feedback loop. The microcontroller sets transistor Q12 on which turns on a current source: transistor Q11 and resistor R15. This controls 0 to 10 ballasts that are sinking/sourcing.

For a PWM load type, the output routine turns transistor Q3 on, thereby turning transistor Q4 on. Moreover, the transistors Q5 and Q12 are turned off. This sets a DC voltage of preferably about 9 volts at the inverting pin of the op-amp U1:A and pulls the gate of transistor Q2 low, thus turning transistor Q2 off, and taking capacitor C1 out of the circuit. The routine turns transistor Q5 off which leaves transistors Q9 and Q10 acting like complementary transistors. The hardware PWM is used to set a PWM at the base of transistor Q1. This is inverted and presented at the inverting pin of the op-amp. The op-amp is used as a comparator as it is faster and minimizes waveform distortion. Turning transistor Q3 on also sets a DC voltage at the non-inverting input of the op-amp, thus making it act like a comparator. Since transistor Q5 is off, transistors Q9 and Q10 form a CMOS switch, switching between 12 volts DC and common. This allows the system to generate a PWM amplitude of preferably about 12 volts. Hence, transistors Q9 and Q10 act like a CMOS switch and generate a PWM for the ballast. Transistors Q12 and Q11 are left off for this load type. Setting transistor Q12 off turns off the current source circuit as it is not needed for this load type.

For a DSI load type, the electrical configuration is the same as that of the PWM, except that the microprocessor U2 generates a serial bit stream at the base of transistor Q1 which is transferred to the output. The output routine calculates the 8 bit code to be transmitted based on the intensity and trim information and turns the output compare on at a predetermined period, e.g., about 833 $\mu$s. The compare service routine sends out the start bit, 8 bit Manchester code, and 4 stop bits on port RC1. Thus, the operation of this load type are identical to that of PWM except that the microcontroller U2 outputs a digital bit stream instead of a PWM, thus allowing the system to control DSI ballasts.

When there is no load type and the system is to turn off (in accordance with steps 440 and 445 in FIG. 7), the microprocessor U2 turns transistor Q5 on and therefore forces transistor Q9 to stay off. The microprocessor U2 also turns transistors Q12 and Q11 off. Transistor Q3 is turned on, thereby putting about 9 volts DC at the non-inverting pin of the op-amp U1:A. Transistor Q1 is left off, thus setting the output of the op-amp low. This forces transistor Q10 to stay off.

Although illustrated and described herein with reference to certain specific embodiments, the present invention is nevertheless not intended to be limited to the details shown. Rather, various modifications may be made in the details within the scope and range of equivalents of the claims and without departing from the invention.

What is claimed:

1. A lighting control system for selectively controlling the light level of a lighting load, comprising:

a lighting control unit for generating zone-intensity information representing a desired light level for said lighting load, said lighting load selected from the group consisting of a voltage controlled load, a duty cycle controlled load, and a digital signal controlled load;

a communications link;

a controller operatively connected to said lighting control unit via said communications link and responsive to said zone-intensity information for adjusting said light level of said lighting load;

means for generating a load signal indicating whether said lighting load is a voltage controlled load, a duty cycle controlled load, or a digital signal controlled load; and a module connected to said controller and adapted to be connectable to said lighting load, said module responsive to said zone-intensity information and said load signal for controlling the light level of said lighting load.

2. The lighting control system of claim 1, further comprising an isolator operatively connected between said controller and said module.

3. The lighting control system of claim 1, further comprising a relay connected between a power source and said lighting load wherein said relay is controlled by said controller.

4. The lighting control system of claim 1, wherein said voltage controlled load comprises either a 0 to 10 volt source controlled load or a 0 to 10 volt sink controlled load, said duty cycle controlled load comprises a pulse width modulated (PWM) controlled load, and said digital signal controlled load comprises a digital serial interface (DSI) controlled load.

5. The lighting control system of claim 1, wherein said module is adapted to independently drive a plurality of lighting loads selected from the group consisting of a voltage controlled load, a duty cycle controlled load, and a digital signal controlled load, and at least two of said plurality of loads are different controlled loads.

6. The lighting control system of claim 1, wherein said module is capable of independently controlling two different loads.

7. The lighting control system of claim 1, further comprising input means for inputting said zone-intensity information to said lighting control unit.

8. The lighting control system of claim 1, further comprising an over-current protector and a miswire protector connected between said module and said associated lighting load.

9. The lighting control system of claim 1, wherein said controller includes said means for generating a load signal.

10. The lighting control system of claim 1, wherein said module includes said means for generating a load signal.

11. A module for controlling the light intensity of a lighting load in a lighting control system, comprising:

input means responsive to a light intensity level and a load signal, said load signal indicative of a lighting load to be coupled to the module, the lighting load selected from the group consisting of a voltage controlled load, a duty cycle controlled load, and a digital signal controlled load; and a controllably conductive device responsive to said light intensity level and said load signal to generate an output signal to said lighting load.

12. The module of claim 11, further comprising a plurality of output terminals in electrical communication with said controllably conductive device, each adapted to be connected to a respective one of a plurality of lighting loads for controlling said light intensity of said plurality of lighting loads.

13. The module of claim 12, wherein said plurality of lighting loads have different lighting load characteristics.

14. The module of claim 11, wherein said voltage controlled load comprises either a 0 to 10 volt source or a 0 to 10 volt sink, said duty cycle controlled load comprises a pulse width modulated load, and said digital signal controlled load comprises a digital serial interface (DSI) load.

15. The module of claim 11, wherein said input means includes a demultiplexer adapted to receive a multiplexed input signal comprising said light intensity level and said load signal, said load signal indicating whether said lighting load is one of said voltage controlled load, said duty cycle controlled load, and said digital signal controlled load.

16. The module of claim 11, wherein said input means is adapted to receive a first input signal comprising said light intensity level and a second input signal comprising said load signal, said load signal indicating whether said lighting load is one of said voltage controlled load, said duty cycle controlled load, and said digital signal controlled load.

17. The module of claim 16, further comprising a selector to generate said second input signal.

18. The module of claim 17, wherein said selector includes a rotary encoder.

19. The module of claim 17, wherein said selector includes a DIP switch.

20. A module for use in a lighting control system for simultaneously controlling a first light intensity of a first lighting load and a second light intensity of a second lighting load, the lighting loads selected from the lighting load group consisting of a voltage-controlled load, a duty cycle-controlled load, and a digital signal-controlled load, the second lighting load different from the first lighting load, comprising:

a receiver for receiving light intensity information associated with said first and second light intensities;

a controller connected to receive said light intensity information from said receiver and provide a first light intensity signal and a second light intensity signal;

means for generating a first load signal and a second load signal, said load signals associated with said first and second lighting loads, respectively;

a first output drive in communication with said controller to receive said first light intensity signal and said first load signal, said first output drive for controlling said first light intensity; and a second output drive in communication with said controller to receive said second light intensity signal and said second load signal, said second output drive for controlling said second light intensity.

21. The module according to claim 20 wherein said first output drive comprises:

a switchable op amp/comparator responsive to said first load signal to operate as an op amp when said first load signal has a first predetermined value, and as a comparator when said first load signal has a second predetermined value.

22. The module according to claim 20 wherein said first output drive comprises:

a switchable analog/digital output driver responsive to said first load signal to operate as an analog signal driver when said first load signal has a first predetermined value, and as a digital signal driver when said first load signal has a second predetermined value.

23. The module according to claim 20 wherein said first output drive comprises:

a switchable current source responsive to said first load signal to operate as a current source when said first load signal has a first predetermined value, and to be disabled when said first load signal has a second predetermined value.

* * * * *

UNITED STATES PATENT AND TRADEMARK OFFICE

CERTIFICATE OF CORRECTION

PATENT NO. : 6,188,181 B1
DATED : February 13, 2001
INVENTOR(S) : Siddharth Prakash Sinha et al.

It is certified that error appears in the above-identified patent and that said Letters Patent is hereby corrected as shown below:

Column 2,
Line 58, delete "oflighting" and insert -- of lighting -- therefor;

Column 10,
Line 42, after "generation." do not begin new paragraph.

Signed and Sealed this

Nineteenth Day of March, 2002

*Attest:*

*Attesting Officer*

JAMES E. ROGAN
*Director of the United States Patent and Trademark Office*